US009462851B2

(12) United States Patent
Baker et al.

(10) Patent No.: US 9,462,851 B2
(45) **Date of Patent: *Oct. 11, 2016**

(54) CABLE TIGHTENING SYSTEM FOR AN ARTICLE OF FOOTWEAR

(71) Applicant: NIKE, Inc., Beaverton, OR (US)

(72) Inventors: Brian D. Baker, Portland, OR (US); John Hurd, Lake Oswego, OR (US); James Molyneux, Portland, OR (US); Blake Rhulen, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/720,233

(22) Filed: May 22, 2015

(65) Prior Publication Data

US 2015/0250267 A1 Sep. 10, 2015

Related U.S. Application Data

(63) Continuation of application No. 13/755,507, filed on Jan. 31, 2013, now Pat. No. 9,049,902, which is a continuation of application No. 12/767,138, filed on Apr. 26, 2010, now Pat. No. 8,387,282.

(51) Int. Cl.
*A43C 11/00* (2006.01)
*A43C 11/16* (2006.01)
(Continued)

(52) U.S. Cl.
CPC ..... *A43C 11/16* (2013.01); *A43B 23/00* (2013.01); *A43C 11/008* (2013.01); *A43C 11/1493* (2013.01); *A43C 11/165* (2013.01)

(58) Field of Classification Search
CPC ..... A43B 23/00; A43B 23/22; A43B 7/14; A43B 7/149; A43C 11/008; A43C 11/1493; A43C 11/16; A43C 11/1655
USPC ..... 36/50.1, 50.5, 91, 131, 133, 72 R, 88
See application file for complete search history.

(56) References Cited

U.S. PATENT DOCUMENTS 4,011,634 A 3/1977 Olivieri
4,020,571 A 5/1977 Olivieri
(Continued)

FOREIGN PATENT DOCUMENTS

CN 1871962 A 12/2006
CN 102958395 A 3/2013
(Continued)

OTHER PUBLICATIONS

International Preliminary Report on Patentability (including Written Opinion of the ISA) for Application No. PCT/US2011/031672, mailed Nov. 8, 2012.
(Continued)

*Primary Examiner* — Marie Bays
(74) *Attorney, Agent, or Firm* — Plumsea Law Group, LLC

(57) ABSTRACT

A tightening system for an article of footwear includes a cable disposed between an upper and a sole plate. The upper includes a flexible main body and an exoskeleton covering a portion of the flexible main body in an instep region. The cable is attached to the exoskeleton so that the exoskeleton is tightened to a wearer's foot when the cable length is effectively shortened and/or if the cable tension is increased. The instep region is devoid of the tightening system so that a smooth instep region is provided.

20 Claims, 22 Drawing Sheets

(51) Int. Cl.
*A43B 23/00* (2006.01)
*A43C 11/14* (2006.01)

(56) References Cited

U.S. PATENT DOCUMENTS

| | | | | |
|---|---|---|---|---|
| 4,037,333 | A | 7/1977 | Olivieri | |
| 4,090,278 | A | 5/1978 | Olivieri | |
| 4,130,949 | A | 12/1978 | Seidel | |
| 4,253,217 | A | 3/1981 | Marzocchi | |
| 4,310,951 | A | 1/1982 | Riedel | |
| 4,326,320 | A | 4/1982 | Riedel | |
| 4,424,636 | A | 1/1984 | Everest | |
| 4,453,290 | A | 6/1984 | Riedel | |
| 4,592,154 | A | 6/1986 | Oatman | |
| 4,619,057 | A | 10/1986 | Sartor et al. | |
| 4,794,706 | A | 1/1989 | Puckhaber et al. | |
| 4,800,659 | A | 1/1989 | Marega | |
| 4,802,290 | A | 2/1989 | Marega | |
| 4,845,864 | A | 7/1989 | Corliss | |
| 4,901,451 | A | 2/1990 | Cumin | |
| 5,105,566 | A | 4/1992 | Legon | |
| 5,129,130 | A | 7/1992 | Lecouturier | |
| 5,291,671 | A * | 3/1994 | Caberlotto | A43B 5/00 36/114 |
| 5,323,549 | A | 6/1994 | Segel et al. | |
| 5,341,583 | A | 8/1994 | Hallenbeck | |
| 5,381,609 | A * | 1/1995 | Hieblinger | A43C 11/165 36/50.1 |
| 5,469,640 | A | 11/1995 | Nichols | |
| 5,555,650 | A | 9/1996 | Longbottom et al. | |
| 5,651,195 | A * | 7/1997 | Clancy | A43B 3/12 36/11.5 |
| 5,755,044 | A | 5/1998 | Veylupek | |
| 5,934,599 | A | 8/1999 | Hammerslag | |
| 6,018,890 | A | 2/2000 | Bowen | |
| 6,052,921 | A * | 4/2000 | Oreck | A43C 1/00 36/50.1 |
| 6,052,924 | A | 4/2000 | Sabat | |
| 6,148,489 | A | 11/2000 | Dickie et al. | |
| 6,199,305 | B1 | 3/2001 | Steuerwald et al. | |
| 6,202,953 | B1 | 3/2001 | Hammerslag | |
| 6,289,558 | B1 | 9/2001 | Hammerslag | |
| 6,289,609 | B1 | 9/2001 | Bowen | |
| 6,449,878 | B1 | 9/2002 | Lyden | |
| 6,601,042 | B1 | 7/2003 | Lyden | |
| 6,643,954 | B2 | 11/2003 | Voswinkel | |
| 6,681,503 | B2 | 1/2004 | Morle | |
| 6,892,429 | B2 | 5/2005 | Sartor et al. | |
| 6,922,917 | B2 | 8/2005 | Kerns et al. | |
| 7,016,867 | B2 | 3/2006 | Lyden | |
| 7,028,420 | B2 | 4/2006 | Tonkel | |
| 7,065,906 | B2 | 6/2006 | Jones et al. | |
| 7,082,703 | B2 | 8/2006 | Greene et al. | |
| 7,107,235 | B2 | 9/2006 | Lyden | |
| 7,200,957 | B2 | 4/2007 | Hubbard et al. | |
| 7,287,342 | B2 * | 10/2007 | Keen | A43B 3/22 36/50.1 |
| 7,428,789 | B2 | 9/2008 | Holzer et al. | |
| 7,562,470 | B2 * | 7/2009 | Keen | A43B 3/22 36/50.1 |
| 7,591,050 | B2 | 9/2009 | Hammerslag | |
| 8,387,282 | B2 * | 3/2013 | Baker | A43C 11/008 36/133 |
| 9,049,902 | B2 * | 6/2015 | Baker | A43C 11/008 |
| 2002/0002781 | A1 * | 1/2002 | Bouvier | A43B 3/0031 36/50.1 |
| 2002/0043007 | A1 | 4/2002 | Hannah | |
| 2002/0095750 | A1 | 7/2002 | Hammerslag | |
| 2004/0043007 | A1 | 3/2004 | Andree et al. | |
| 2004/0181972 | A1 * | 9/2004 | Csorba | A43B 7/1495 36/50.1 |
| 2005/0022427 | A1 | 2/2005 | Kerns et al. | |
| 2005/0102861 | A1 | 5/2005 | Martin | |
| 2005/0210706 | A1 | 9/2005 | Johnson | |
| 2006/0000116 | A1 | 1/2006 | Brewer | |
| 2006/0116483 | A1 | 6/2006 | Tonkel | |
| 2006/0201031 | A1 | 9/2006 | Jones et al. | |
| 2007/0000105 | A1 | 1/2007 | Grande et al. | |
| 2007/0011914 | A1 * | 1/2007 | Keen | A43B 1/14 36/50.1 |
| 2007/0033836 | A1 | 2/2007 | Rasmussen | |
| 2007/0043630 | A1 | 2/2007 | Lyden | |
| 2007/0186447 | A1 | 8/2007 | Ramos | |
| 2007/0277398 | A1 | 12/2007 | Davis et al. | |
| 2008/0235990 | A1 | 10/2008 | Wegener | |
| 2008/0307673 | A1 | 12/2008 | Johnson | |
| 2009/0205221 | A1 | 8/2009 | Mitchell | |
| 2011/0258876 | A1 * | 10/2011 | Baker | A43C 11/008 36/50.1 |
| 2014/0033576 | A1 | 2/2014 | Baker et al. | |

FOREIGN PATENT DOCUMENTS

| | | | |
|---|---|---|---|
| EP | 1064863 | A1 | 1/2001 |
| EP | 1421868 | A1 | 5/2004 |
| EP | 2563176 | A2 | 3/2013 |
| FR | 2827486 | A1 | 1/2003 |
| WO | 9215214 | A1 | 9/1992 |
| WO | 2011139474 | A2 | 11/2011 |

OTHER PUBLICATIONS

International Search Report and Written Opinion for Application No. PCT/US2011/031672, mailed on Dec. 8, 2011.

Office Action issued Aug. 28, 2014 in Chinese Patent Application No. 201180031704.X.

Response dated Jan. 12, 2015 for Chinese Application No. 201180031704.X.

Response to Written Opinion and Voluntary Amendments filed Jan. 28, 2013 in European Patent Application No. 11777784.7.

The BOA System, How It Works, [Retrieved on Dec. 18, 2008], Retrieved from the internet.

Office Action issued Mar. 20, 2015 in Chinese Patent Application No. 201180031704.X.

Response dated Aug. 4, 2015 for Chinese Application No. 201180031704.X.

Notification of the Decision to Grant dated Aug. 31, 2015 for Chinese Application No. 201180031704.X.

* cited by examiner

CABLE TIGHTENING SYSTEM FOR AN ARTICLE OF FOOTWEAR

CROSS-REFERENCE TO RELATED APPLICATIONS

This application is a continuation of Baker et al., U.S. Patent Application Publication Number US 2014/0033576; which is a continuation of Baker et al., U.S. Patent Publication Number US 2011/0258876 A1, now issued as U.S. Pat. No. 8,387,282, which are both incorporated by reference herein in their entireties.

BACKGROUND

The present invention relates to a tightening system for an article of footwear, and, more particularly, to a tightening system including cables positioned between the upper and the sole to provide a smooth instep region.

In some instances, an article of footwear having a smooth instep may be desirable. For example, certain athletic activities may be enhanced if the article of footwear includes a smooth instep. A soccer player may find passing or controlling the ball easier if the instep region is devoid of potentially interfering elements, such as laces or protruding embellishments. In other words, the article of footwear may be configured to provide a clear kicking surface.

Typically, however, an article of footwear includes an adjustment system in the instep region of the article of footwear. For example, laces to control the size of the throat opening typically extend along the instep of an article of footwear from the throat opening towards the toe region. Some articles of footwear may eliminate such adjustment systems, such as slip on shoes. However, these articles of footwear are not able to be tightened and loosened on the wearer's foot, which may lead to an imperfect fit.

Some articles of footwear have provided adjustment systems that avoid the instep region. For example, U.S. Pat. No. 5,381,609 provides an athletic shoe with a closure system for tightening the vamp. The closure system includes an instep cover that is formed of an elastically bendable material that matches a surface contour of at least a portion of the instep. A tightening element runs along the instep cover to a central closure mechanism located on the back of the shoe above the heel. However, the instep cover does not provide a smooth surface. Further, the instep cover is elastomeric, which may not provide a sufficiently tight fit.

Therefore, a need exists in the art for an article of footwear that provides a smooth instep region.

SUMMARY

In one aspect, the invention provides an article of footwear comprising an upper having a throat opening configured to allow a foot to be inserted into the upper, the upper having a first layer and a second layer, wherein the first layer coincident with an entirety of the upper. The second layer is positioned on the first layer so that the second layer covers at least a portion of an instep region of the article of footwear. A sole and a tightening system are associated with the upper. The tightening system includes a cable, where the cable disposed between the upper and the sole so that the instep region of the upper is devoid of the cable. A pull tab is associated with the cable on a medial side of the article of footwear, and a pull tab securing location is positioned on a lateral side of the article of footwear, wherein tension is applied to the cable when the pull tab is moved toward the pull tab securing location.

In another aspect, the invention provides an article of footwear comprising an upper comprising a first layer and a second layer, the first layer defining a shape of the upper, and the second layer having a main body positioned to cover a portion of an instep of the first layer. A first portion of the second layer extends into a toe region of the article of footwear. A second portion of the second layer extends to a medial side of the article of footwear in a forefoot region of the article of footwear. A third portion of the second layer extends to a lateral side of the article of footwear in the forefoot region of the article of footwear. A fourth portion of the second layer extends to the medial side of the article of footwear in an arch region of the article of footwear. A fifth portion of the second layer extends to the lateral side of the article of footwear in the arch region of the article of footwear. A sixth portion of the second layer extends to the medial side of the article of footwear proximate a throat opening. A seventh portion of the second layer extends to the lateral side of the article of footwear proximate the throat opening. A cable is configured to tighten the article of footwear to a foot by drawing the second layer toward the sole when tension is applied to the cable, wherein the cable is slidably associated with the second portion, the third portion, the fourth portion, the fifth portion, the sixth portion, and the seventh portion, and wherein the cable is positioned between the upper and a sole.

In another aspect, the invention provides an article of footwear comprising an upper having a first layer and a second layer, the second layer covering a portion of an instep region of the first layer. The second layer is substantially smooth. A cable is associated with the second layer, wherein the cable is associated with a periphery of the second layer so that the instep region is devoid of the cable. The cable extends between the upper and a sole, wherein the second layer is tightened to the first layer when tension is applied to the cable.

In another aspect, the invention provides an article of footwear comprising an upper having a first layer and a second layer. The second layer covers an instep region of the first layer. The second layer provides a substantially smooth surface on the instep region. The second layer is attached to the first layer to form a first saddle-shaped pocket at a medial edge of the second layer on a medial side of the article of footwear and a second saddle-shaped pocket at a lateral edge of the second layer on a lateral side of the article of footwear. A cable extends between the upper and a sole, wherein a first portion of the cable is threaded through the first saddle-shaped pocket and a second portion of the cable is threaded through the second saddle-shaped pocket. A cable tightener is positioned in a heel region of the article of footwear, wherein the cable tightener is configured to modify the cable to adjust the position of the second layer.

In another aspect, the invention provides an article of footwear comprising an upper comprising a first layer and a second layer. The upper is associated with a sole. The second layer is attached to the first layer so that a portion of the second layer covers a portion of an instep region of the upper. The second layer is substantially smooth. A cable extends between the upper and the sole, wherein the cable is configured to move with respect to the upper and the sole. A saddle-shaped portion of the cable is disposed between the second layer and the first layer. A spindle is disposed in a heel region of the article of footwear, wherein the cable is wound around the spindle to tighten the article of footwear to a foot.

In another aspect, the invention provides an article of footwear comprising an upper and a sole associated with the upper. A cable is also associated with the article of footwear, wherein a portion of the cable is disposed between the upper and the sole, and wherein the cable is slidable with respect to the upper and the sole. A spindle is disposed in a heel region of the article of footwear, wherein the cable is associated with the spindle so that the spindle winds the cable to increase the tension in the cable. A second portion of the cable extends straight across the article of footwear in a forefoot region between the upper and the sole. A third portion of the cable extends diagonally across the article of footwear between the upper and the sole, and a fourth portion of the cable extending diagonally across the article of footwear between the upper and the sole so that the fourth portion of the cable crosses the third portion of the cable.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
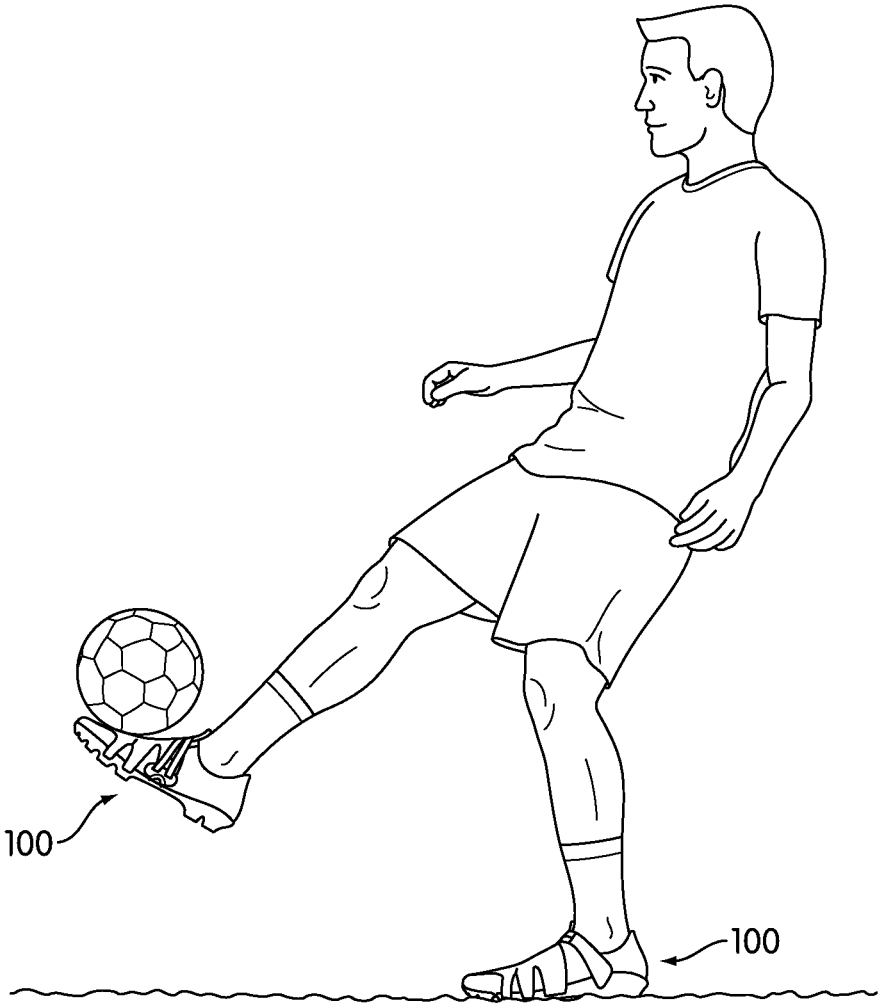
FIG. 1 shows an athlete wearing an embodiment of an article of footwear with a smooth instep region while passing a soccer ball.
Figure 2:
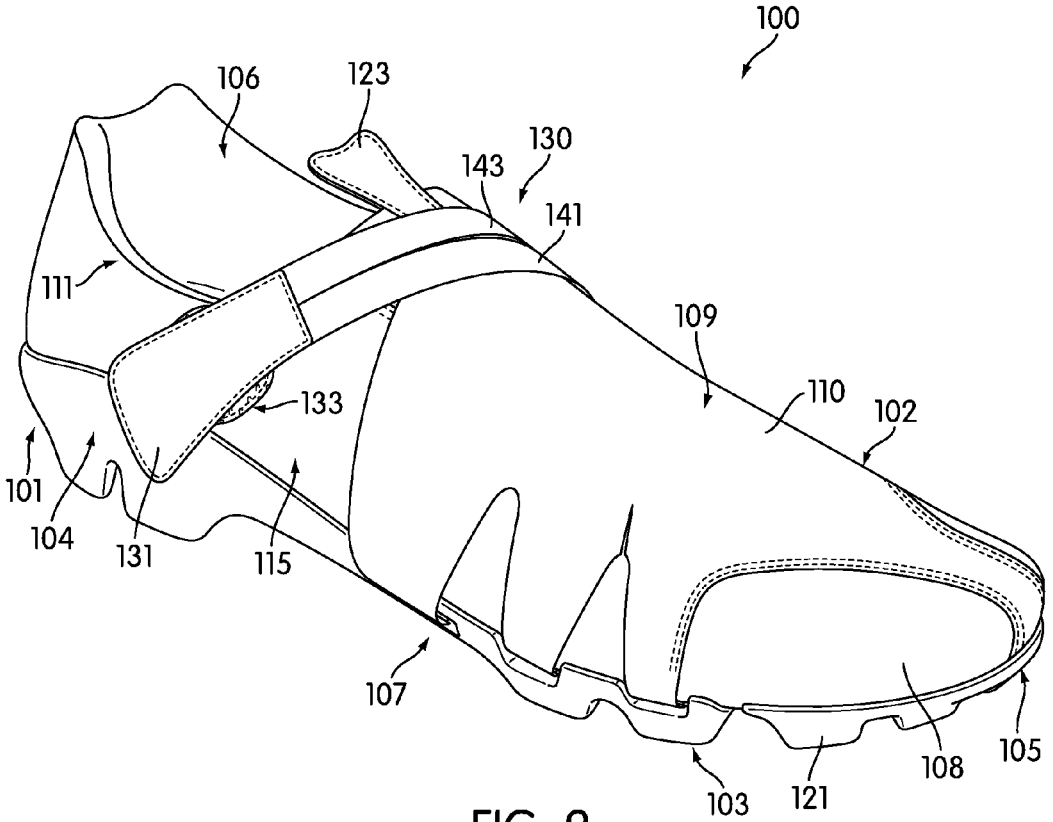
FIG. 2 is a perspective view of an embodiment of article of footwear having a smooth instep region and a cable tightening system with the system tightened.

When participating in certain activities, it is desirable to have an article of footwear with a smooth instep region. For the purposes of this discussion, the instep region may generally be considered to be the upper surface of the foot, between the ankle and the toes. One activity in which a smooth instep region is desirable is soccer, as shown in FIG. 1. When handling a soccer ball, having a smooth instep region allows for more precise ball control, because surface features of the article of footwear do not interfere with the ball control. For example, when the ball encounters laces, the ball may be unintentionally influenced by the shape of the laces. An article of footwear may be provided that includes a smooth instep region. Various embodiments of such an article of footwear are shown in FIGS. 1-24. These embodiments show articles of footwear that provide a smooth instep region by disposing the tightening system between the upper and the sole.

FIGS. 1-14 show an embodiment of an article of footwear 100 having a smooth instep region. Article of footwear 100 generally includes upper 102 associated with sole 104. Article of footwear 100 may be considered to have various reference regions, as shown in at least FIG. 2: heel region 101, forefoot region 103, toe region 105, midfoot region 107, instep region 109, throat opening region 111. Forefoot region 103 generally includes portions of article of footwear 100 corresponding with the toes and the joints connecting the metatarsals with the phalanges, while toe region 105 specifically denotes the foremost region of article of footwear including the toe box. Midfoot region 107 generally includes portions of article of footwear 100 corresponding with the arch area of the foot, and heel region 101 corresponds with rear portions of the foot, including the calcaneus bone. Additionally, article of footwear 100 includes medial region 113, shown in FIG. 5, that generally corresponds to the inside of the foot. Similarly, article of footwear 100 also includes lateral region 115, shown in FIG. 2, that generally corresponds to the outside of the foot. These regions and sides designations are not intended to demarcate precise areas of article of footwear 100, and may be applied to upper 102 and sole 104 individually in addition to article of footwear 100 as a whole.

Sole 104 is generally configured as a ground-engaging portion of article of footwear 100. In one embodiment, sole 104 is made of a material capable of providing traction against the ground, such as rubber. In some embodiments, sole 104 is a multi-layer sole. Such multi-layer soles are well known in the art, and may include a ground-engaging outsole, a cushioning midsole, and an insole configured to contact a foot.

A sole length may extend from toe region 105 of sole 104 to heel region 101 of sole 104. A sole width may be perpendicular to the sole length and may extend from the lateral side to the medial side of sole 104. Sole 104 may vary in width at different points from the front to the rear of footwear 100. For example, sole 104 may have a first width in toe region 105 and a second width in midfoot region 107. Sole 104 may also vary in width from the front to the rear of a single region. For example, sole 104 may have a smaller width at the front of toe region 105 than at the rear of toe region 105.

Figure 4:
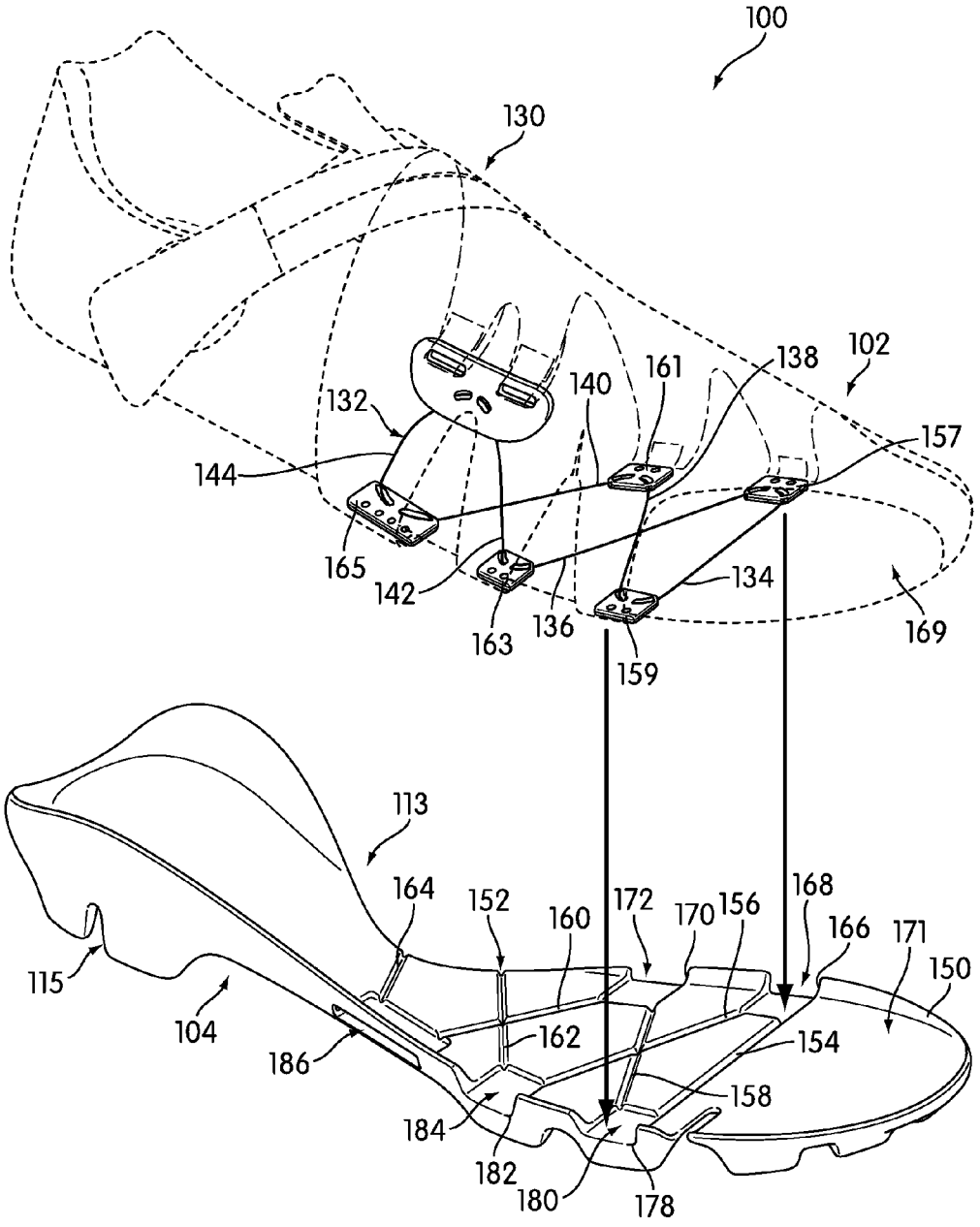
FIG. 4 is an exploded view of an embodiment of an article of footwear showing a cable tightening system positioned between the upper and the sole, with the upper shown in phantom.

In some embodiments, sole 104 may include a sole plate 150, as shown in FIG. 4. In such embodiments, sole plate 150 may provide a relatively rigid surface that defines a shape of sole 104 with an elastomeric ground-engaging layer associated with sole plate 150. In some embodiments, sole plate 150 may be the upper portion of sole 104 configured to contact and be associated with upper 102.

A sole plate width may extend from the lateral side to the medial side of sole plate 150. Sole plate 150 may vary in width from toe region 105 to heel region 101 of footwear 100.

In some embodiments, sole 104 may include one or more cleats 121. Cleats 121 protrude away from sole plate 150. Cleats 121 may be provided on an article of footwear when the intended use of the article of footwear is a turf sport, such as soccer or football. The sole structure is not limited solely to footwear designed for these activities, however, and may be utilized with a wide range of athletic footwear styles, including running shoes, tennis shoes, football shoes, cross-training shoes, walking shoes, soccer shoes, and hiking boots, for example. The sole structure may also be utilized with footwear styles that are generally considered to be non-athletic, including dress shoes, loafers, sandals, and boots. An individual skilled in the relevant art will appreciate, therefore, that the concepts disclosed herein apply to a wide variety of footwear styles, in addition to the specific style discussed in the following material and depicted in the accompanying figures.

Upper 102 is preferably sized and dimensioned to receive a wearer's foot. The foot may be inserted into upper 102 through throat opening 106. Upper 102 may optionally include a pull 123 configured to assist a wearer in pulling article of footwear 100 onto the foot. Pull 123 may be made of any material capable of being securely attached to upper 102 and grasped with the fingers. Pull 123 may have any shape conducive to being grasped by the fingers. Upper 102 includes multiple layers. In the embodiment shown in the figures, upper 102 includes two layers: a main body 108 and an exoskeleton 110.

Main body 108 is generally configured to define the size and shape of upper 102. Main body 108 is coincident with upper 102 in that main body 108 is generally coextensive with upper 102. In some embodiments, main body 108 is sized and shaped to substantially encase the wearer's foot. In other embodiments, main body 108 may cover large portions of the foot but may not substantially encase the foot. Main body 108 may be made of any material known in the art, including natural and synthetic textiles, foam, leather, and synthetic leather. In some embodiments, main body 108 may be made of a light and flexible material.

Exoskeleton 110 is generally configured to provide a smooth instep region 109. Exoskeleton 110 may be made from any material known in the art, including natural and synthetic textiles, foam, leather, and synthetic leather. In some embodiments, exoskeleton 110 may be made from a smooth portion of material. In some embodiments, exoskeleton 110 may be made from a composite material, where the smooth portion of material is reinforced with filaments to strengthen exoskeleton 110 so that exoskeleton 110 provides additional structural support to upper 102 and can also better withstand long term wear. Exoskeleton 110 may, in some embodiments, be made of a relatively inelastic material. Exoskeleton 110 may be used to tighten article of footwear 100 to a wearer's foot by pulling exoskeleton 110 towards sole 104. This may be more readily accomplished if exoskeleton 110 maintains its size and shape, i.e., if exoskeleton 110 does not stretch when pulled.

In some embodiments, exoskeleton 110 may be more stiff than main body 108. Exoskeleton 110 may be stiffer than main body 108 by material selection, by making exoskeleton 110 thicker than main body 108, or by reinforcing exoskeleton 110, such as with filaments or with additional layers of material. Exoskeleton 110 may be stiffer than main body 108 to support fastening system 130.

Exoskeleton 110 is positioned on main body 108 so that exoskeleton 110 covers at least a portion of instep region 109. While exoskeleton 110 may have any shape that covers at least a portion of instep region 109, in some embodiments exoskeleton 110 has a shape that covers a substantial portion of midfoot region 107 and forefoot region 103 of upper 102. In some embodiments, exoskeleton 110 may also have a shape that enhances the ability of fastening system 130 to be attached to exoskeleton 110. For example, in some embodiments, it may be desirable to attach a portion of fastening system 130 to a periphery of exoskeleton 110. Because one aspect of article of footwear 100 is to have a smooth instep region 109, the periphery of exoskeleton 110 may be shifted toward a sole-upper interface. In the embodiment shown in the figures, this is accomplished by having extensions of exoskeleton 110 descend towards the sole-upper interface: first medial extension 112, second medial extension 114, third medial extension 116, fourth medial extension 118, first lateral extension 120, second lateral extension 122, and third lateral extension 124. Additionally, toe extension 126 may be provided that reaches a point at or proximate a sole-upper interface in toe region 105. Using these extensions maintains the flexibility of upper 102 by having portions of the potentially stiffer exoskeleton 110 extend toward the sole-upper interface while still exposing large sections of the more flexible main body 108. As shown in the figures, the extensions of exoskeleton may not cover first medial exposed section 302, second medial exposed section 304, third medial exposed section 306, first lateral exposed section 308, second lateral exposed section 310, and third lateral exposed section 312 of main body 108.

Exoskeleton 110 may be associated with main body 108 using any method known in the art, such as with an adhesive, welding, or the like. In some embodiments, as shown in the figures, exoskeleton 110 is partially attached to main body 108 with stitching 128. The rest of exoskeleton 110 is detached from main body 108, which allows exoskeleton 110 to move with respect to main body. In some embodiments, stitching 128 is confined to toe region 105, while in other embodiments, stitching 128 may extend over a greater or lesser portion of exoskeleton. In the embodiment shown in the figures, stitching 128 extends over toe extension 126, a portion of first medial extension 112, and a portion of first lateral extension 120, while the rest of exoskeleton 110 is detached from main body 108.

In some embodiments, exoskeleton 110 may be configured to correspond to the anatomy of the foot. Exoskeleton 110 may have a shape that corresponds to at least one of heel region 101, forefoot region 103, toe region 105, midfoot region 107, instep region 109, and throat opening region 111. In some embodiments, exoskeleton 110 may correspond to the anatomy of the foot by varying the shape, number, and location of the extensions and the corresponding large exposed sections of main body 108. In some embodiments, the extensions of exoskeleton 110, such as toe extension 126, first medial extension 112, second medial extension 114, third medial extension 116, fourth medial extension 118, first lateral extension 120, second lateral extension 122, and third lateral extension 124, may extend toward the sole-upper interface and expose large sections of main body 108 so as to correspond to the anatomy of the foot. In the embodiment shown in the figures, toe extension 126 extends toward the sole-upper interface exposing first medial exposed section 302 and first lateral exposed section 308 of main body 108 so as to correspond to the anatomy of the metatarsals. First medial extension 112, second medial extension 114, third medial extension 116, first lateral extension 120, second lateral extension 122 and third lateral extension 124 extend toward the sole-upper interface exposing second medial exposed section 304, third medial exposed section 306, second lateral exposed section 310 and third lateral exposed section 312 of main body 108 so as to correspond to the anatomy of the arch and contours of the foot.

Figure 3:
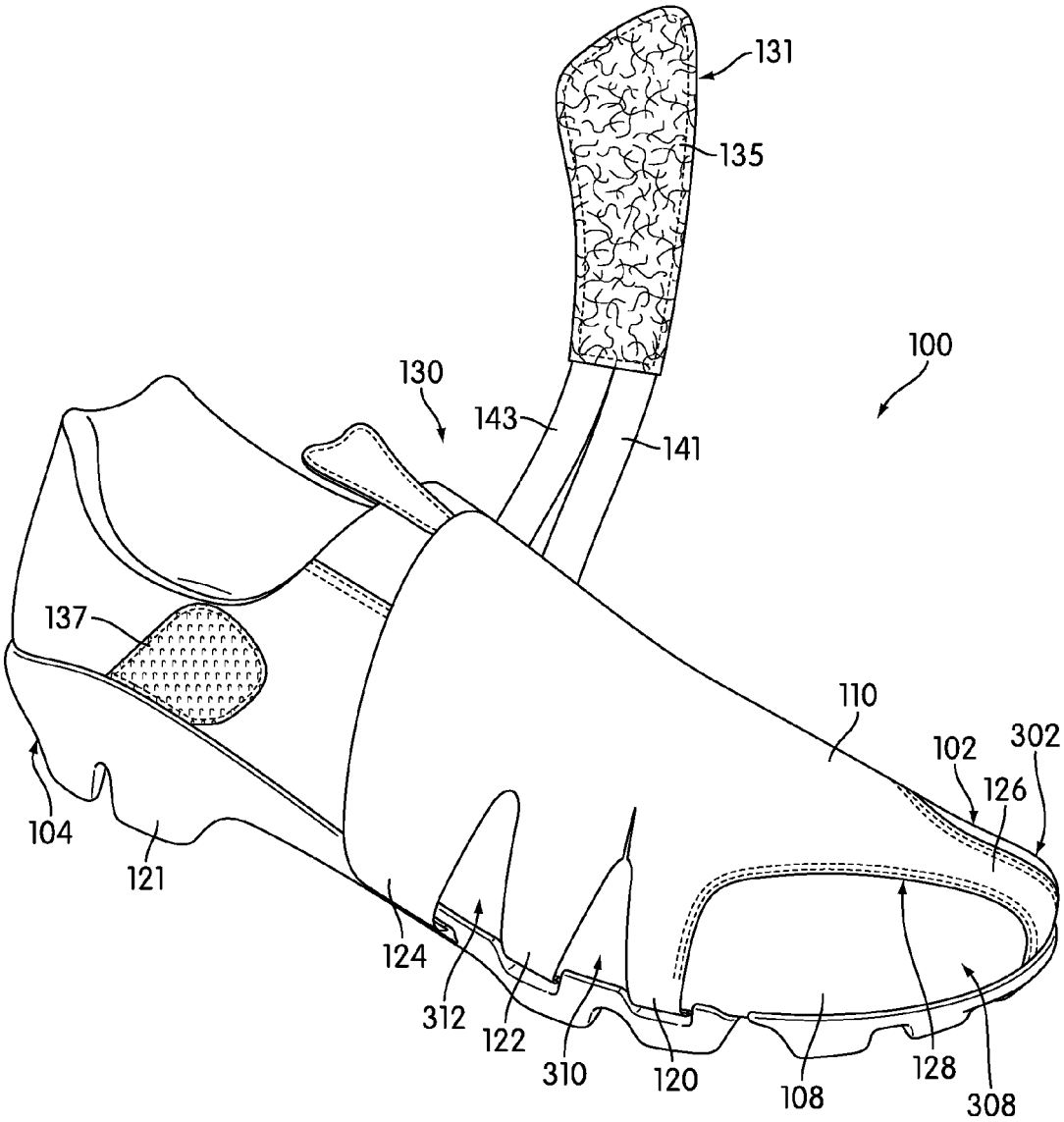
FIG. 3 is a perspective view of an embodiment of an article of footwear having a smooth instep region and a cable tightening system with the system loosened.
Figure 5:
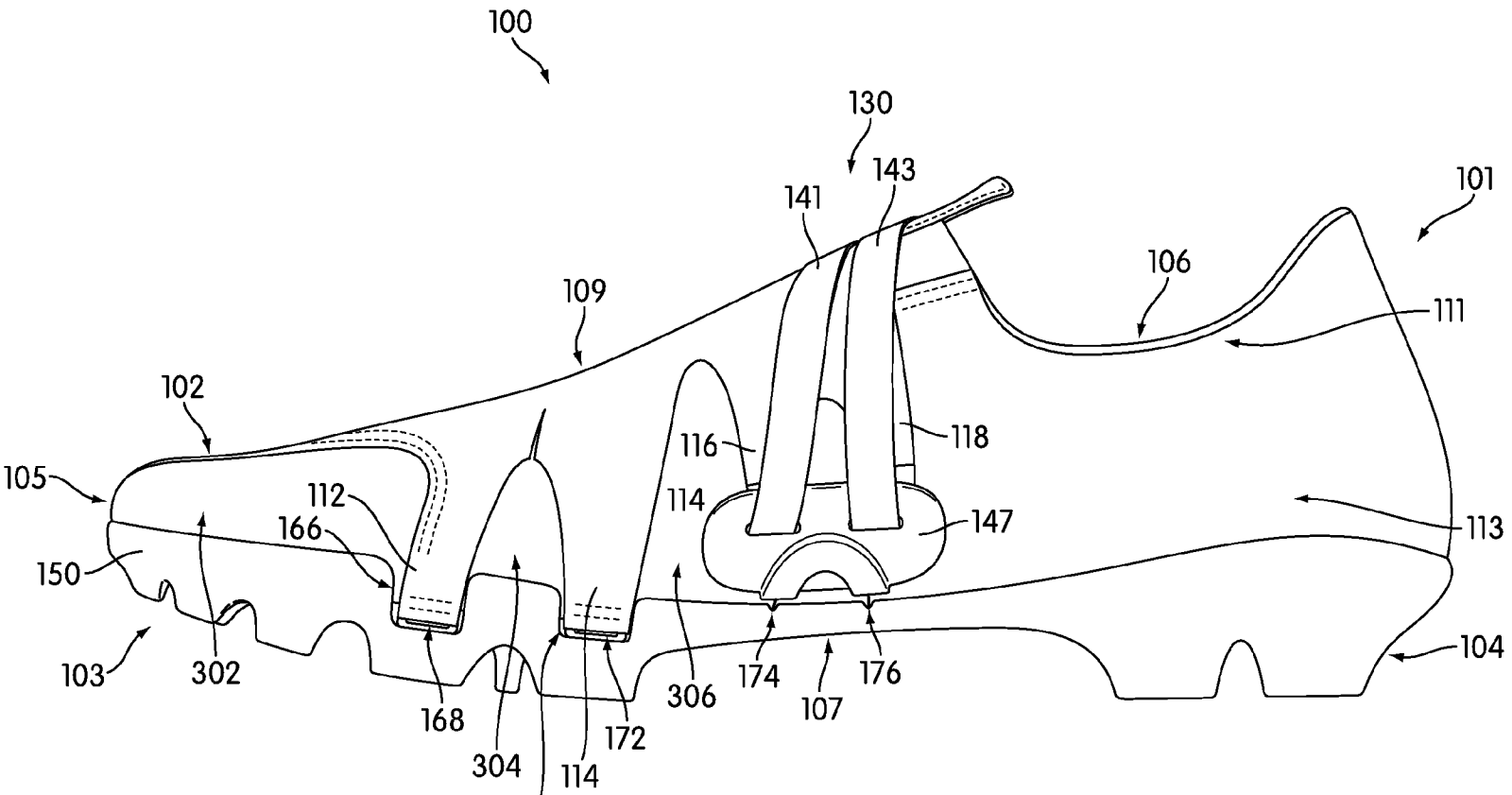
FIG. 5 is a medial side view of an embodiment of an article of footwear having a cable tightening system and a smooth instep region.

Exoskeleton 110 may be configured to be more rigid in a direction of force applied by a user so as to prevent or reduce stretching. In some embodiments, exoskeleton 110 may be configured to prevent or reduce stretching in a direction of force applied by a user while allowing flexibility for articulation or bending of the foot. In some embodiments, the rigidity of exoskeleton 110 may be accomplished by the shape of exoskeleton 110. The location, shape and tension of the extensions of exoskeleton 110 with respect to the sole-upper interface may be configured to correspond to a desired rigidity. The exposed large sections of the more flexible main body 108 may allow for more flexibility of upper 102 than those sections covered by exoskeleton 110. In some embodiments, specific exposed large sections of main body 108 may provide flexibility for certain movements, such as articulation of the foot. Referring to FIGS. 3 and 5, second medial exposed section 304 and second lateral exposed section 310 each have a notch that may allow for more articulation than first medial exposed section 302, third medial exposed section 306, first lateral exposed section 208 and third lateral exposed section 312.

Amount and location of rigidity may be adjusted by changing the configuration of the extensions of exoskeleton 110 and the exposed large sections of the more flexible main body 108. Changing the size, the shape, the number or the location of the exposed large sections of the more flexible main body 108 and the extensions of the exoskeleton 110 may change the rigidity of exoskeleton 110. In the embodiment shown in the figures, the location and shape of the extensions of exoskeleton 110 with respect to the sole-upper interface prevent or reduce stretching in a direction of force applied by a user, for example, when a user is cutting, but the location and shape of the exposed large sections of the more flexible main body 108 allow for articulation or bending of the foot.

Exoskeleton 110 may be used to tighten footwear 100 to the foot by pulling exoskeleton 110 towards sole 104. In some embodiments, exoskeleton 110 may conform to the shape of sole plate 150 as exoskeleton 110 is tightened. Sole plate 150 may define how tightly exoskeleton 110 may be pulled towards the foot at a given location around sole 104. In some embodiments, sole plate 150 may have a narrowest width in the arch area. The narrow width of sole plate 150 may function to allow exoskeleton 110 to be tightest about the foot at the arch area. FIG. 4 shows an embodiment of sole plate 150 having a narrowest width in the arch area. Exoskeleton 110 may provide additional support and fit to the arch of the foot when exoskeleton 110 is tightest within or proximate to the arch area.

Exoskeleton 110 may be used as part of fastening system 130. Fastening system 130 is generally configured to tighten or secure article of footwear 100 to a wearer's foot. To prevent fastening system 130 from interfering with instep region 109, fastening system 130 extends between upper 102 and sole 104. In some embodiments, such as those shown in the figures, fastening system 130 generally includes a cable 132 and a tightening mechanism for adjusting cable 132. Cable 132 may be made of any material known in the art, such as metals, textiles, fiber components, or the like. Cable 132 may have any size or shape known in the art, for example, a single filament, separate filaments bound or braided together, or may include a flat ribbon of material. When a single portion of material is used for cable 132, the ends of cable 132 may be attached to each other to form a loop. Though not shown, the ends of cable 132 may be attached to each other using any method known in the art, such as a mechanical connector, welding, with an adhesive, or the like. Cable 132 may be attached to upper 102.

In some embodiments, cable 132 may be attached to one layer of upper 102. In the embodiments shown in the figures, cable 132 is associated with exoskeleton 110. Cable 132 is associated with exoskeleton 110 so that when cable 132 is modified, the position of exoskeleton 110 with respect to main body 108 and sole 104 is adjusted. For example, if the tension in cable 132 is increased and/or if the effective length of cable 132 is decreased, exoskeleton 110 may be pulled toward main body 108 and sole 104. Similarly, if the tension in cable 132 is decreased and/or if the effective length of cable 132 is increased, exoskeleton 110 may be loosened from or pulled away from main body 108 and sole 104.

Cable 132 may be associated with exoskeleton 110 so that the adjustment of cable 132 provides a relatively even application of force against exoskeleton 110. This allows for a uniform tightening of exoskeleton 110 against a wearer's foot so that pressure points on the wearer's foot may be avoided. In some embodiments, cable 132 may be associated with exoskeleton 110 around a periphery of exoskeleton 110. Cable 132 may be associated with exoskeleton 110 around the entirety of the periphery of exoskeleton 110 or only at a few discrete points. In embodiments such as those shown in FIGS. 1-14, cable 132 may be attached to exoskeleton 110 on first medial extension 112, second medial extension 114, third medial extension 116, fourth medial extension 118, first lateral extension 120, second lateral extension 122, and third lateral extension 124.

Cable 132 may be looped around a periphery of exoskeleton 110 in any manner known in the art. In some embodiments, as shown in FIG. 4, however, cable 132 is positioned between upper 102 and sole 104 and extends back and forth across article of footwear 100 underneath upper 102. Although a contiguous loop of material, cable 132 may be considered to be separated by the configuration of cable 132 between sole 104 and upper 102 into several segments: first segment 134, second segment 136, third segment 138, fourth segment 140, fifth segment 142, and sixth segment 144. In some embodiments, the segments of cable 132 may have different or substantially different lengths, in other embodiments, such as the embodiment shown in FIG. 4, the segments of cable 132 each have approximately the same length. While each segment may have any desired position between upper 102 and sole 104, in the embodiment shown in FIG. 4, the segments span a bottom surface 169 of upper 102 in a cross-cross pattern that extends from a forefoot region 103 to midfoot region 107.

First segment 134 extends substantially straight across bottom surface 169 from lateral side 115 to medial side 113. The medial end of first segment 143 transitions into the medial end of second cable segment 136. Second cable segment 136 then extends diagonally across bottom surface 169 towards lateral side 115 in the midfoot region of article of footwear 100. Similarly, the lateral end of first segment 134 transitions into the lateral end of third cable segment 138. Third cable segment 138 then extends diagonally across bottom surface 169 towards medial side 113 in the midfoot region of article of footwear 100. Second cable segment 136 and third cable segment 138 intersect or cross each other. Because second cable segment 136 and third cable segment 138 are of a similar length in this embodiment and extend across bottom surface 169 at approximately the same angle, second cable segment 136 and third cable segment 138 bisect each other proximate a transverse centerpoint of bottom surface 169. In some embodiments, second cable segment 136 is disposed adjacent bottom surface 169 in the vicinity of the intersection of second cable 136 and third cable segment 138. In other embodiments, third cable segment 138 is disposed adjacent bottom surface 169 in the vicinity of the intersection of second cable 136 and third cable segment 138.

While in some configurations, cable 132 may cross over itself only once, cable 132 may cross over itself more than once. As shown in FIG. 4, a lateral side of second cable segment 136 transitions to a lateral side of fifth cable segment 142. Fifth cable segment 142 then extends diagonally away from lateral side 115 toward medial side 113 near the throat opening region of article of footwear 100. Similarly, the medial side of third cable segment 138 transitions to a medial side of fourth cable segment 140. Fourth cable segment 140 then extends diagonally away from medial side 113 toward lateral side 115 near the throat opening region of article of footwear 100. Fourth cable segment 140 intersects fifth cable segment 142. Because fourth cable segment 140 and fifth cable segment 142 are of similar lengths and extend across bottom surface at approximately the same angle, fourth cable segment 140 and fifth cable segment 142 essentially bisect each other or cross each other at approximately the transverse centerpoint of bottom surface 169.

To complete the loop of cable 132, the lateral end of fifth cable segment 142 transitions into a lateral end of sixth cable segment 144 and a medial end of fourth cable segment 140 transitions into a medial end of sixth cable segment 144. Sixth cable segment 144 then extends substantially straight across bottom surface 169 to complete the loop of cable 132.

Sole 104 may include provisions for accommodating cable 132 so that cable 132 may move freely between upper 102 and sole 104. In some embodiments, as may best be seen in FIG. 4, sole plate 150 of sole 104 may include a channel system 152. Channel system 152 is configured to receive cable 132. Channel system 152 is a groove or a series of grooves formed in an upper surface 171 of sole plate 150. Channel system 152 extends into sole plate 150 to a depth sufficient to accommodate cable 132.

Recessing cable 132 into sole plate 150 also inhibits the ability of a wearer to feel cable 132 when article of footwear 100 is being worn and to feel the movement of cable 132 when cable 132 is being adjusted. This allows for a more comfortable wear experience.

Channel system 152 may have any desired configuration, but in some embodiments, the configuration of channel system 152 corresponds to the configuration selected for cable 132. Having a corresponding configuration allows not only for the accommodation of cable 132, but also to guide the movement of cable 132 when cable 132 is being adjusted. For example, if cable 132 is a simple loop around a periphery of upper 102, then channel system 152 may be a track that extends around a periphery of upper surface 171 of sole plate 150. In the embodiment shown in FIG. 4, channel system 152 is configured to align with the configuration of cable 132. Channel system 152 is divided into several portions that correspond to the segments of cable 132: first channel 154 shaped, sized, and positioned to receive first segment 134, second channel 156 shaped, sized, and positioned to receive second segment 136, third channel 158 shaped, sized, and positioned to receive third segment 138, fourth channel 160 shaped, sized, and positioned to receive fourth segment 140, fifth channel 162 shaped, sized, and positioned to receive fifth segment 142, and sixth channel 164 shaped, sized, and positioned to receive sixth segment 144. When upper 102 is mated with sole 104, cable 132 may be received within and reside within channel system 152. When cable 132 is adjusted, cable 132 may slide within channel system 152 and be guided by the walls of each channel.

Cable 132 may be directly associated with exoskeleton 110, such as by stitching, adhering, or welding cable 132 to exoskeleton or by puncturing exoskeleton 110 and threading cable 132 through the puncture points. In some embodiments, cable 132 may be indirectly associated with exoskeleton 110, such as by providing one or more cable connectors such as first cable connector 157, second cable connector 159, third cable connector 161, fourth cable connector 163, and fifth cable connector 165. Each cable connector may be fixedly attached to exoskeleton 110 using any method known in the art, such as by clamping, adhering, welding, or stitching. Each cable connector may be made from any material known in the art, such as thermoplastic materials, thermoset materials, metals, ceramics, composite materials, or the like. Each cable connector may be made using any method known in the art, such as by injection molding, forging, or the like.

Figure 6:
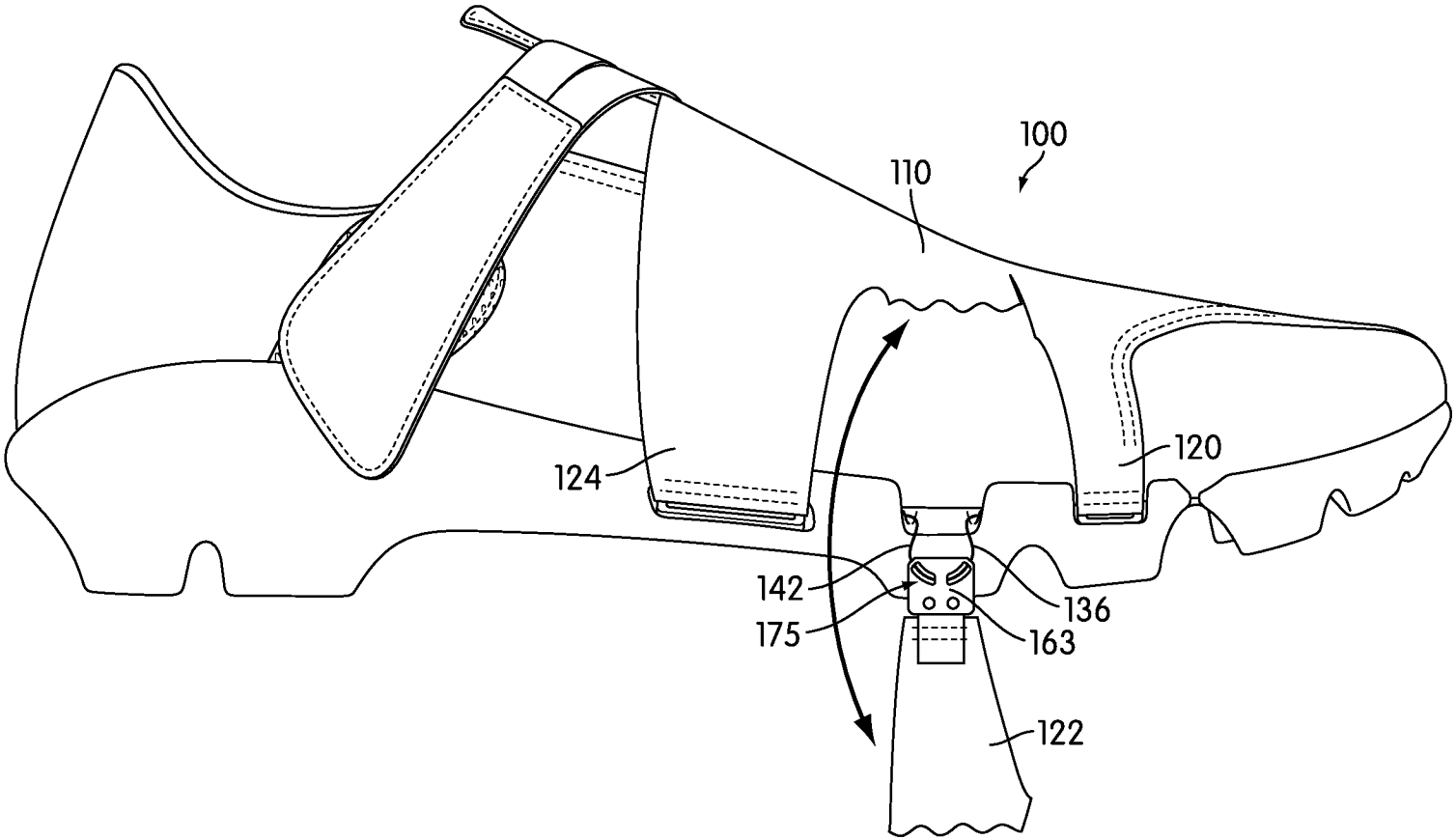
FIG. 6 is a lateral side view of an embodiment of an article of footwear having a cable tightening system and a two layer upper, with a portion of one layer of the upper peeled away to show the connection of the cable system to the layer.
Figure 7:
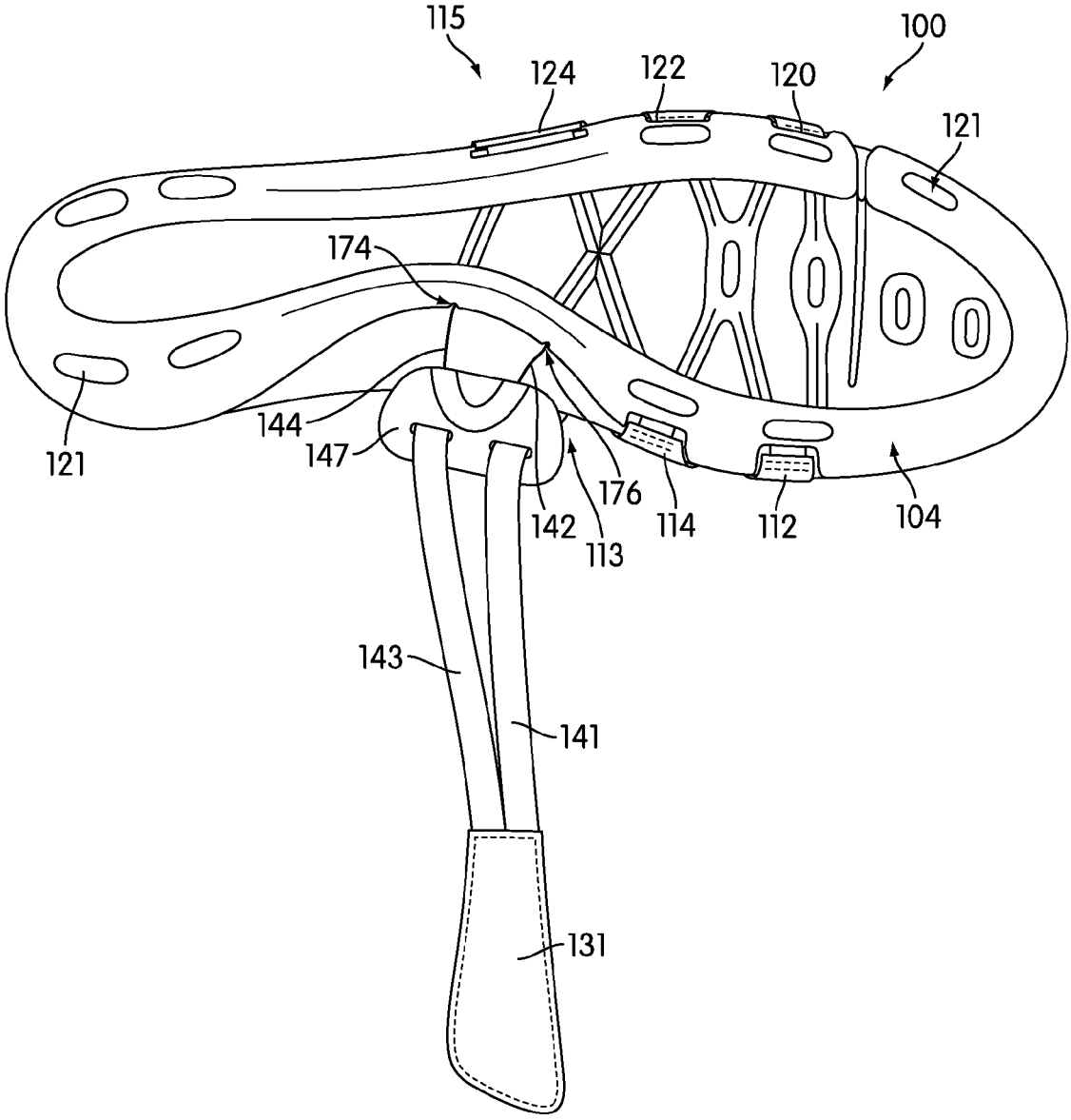
FIG. 7 is a bottom plan view of an embodiment of an article of footwear having a cable tightening system, showing the channels in the sole to accommodate the cables of the cable tightening system.
Figure 9:
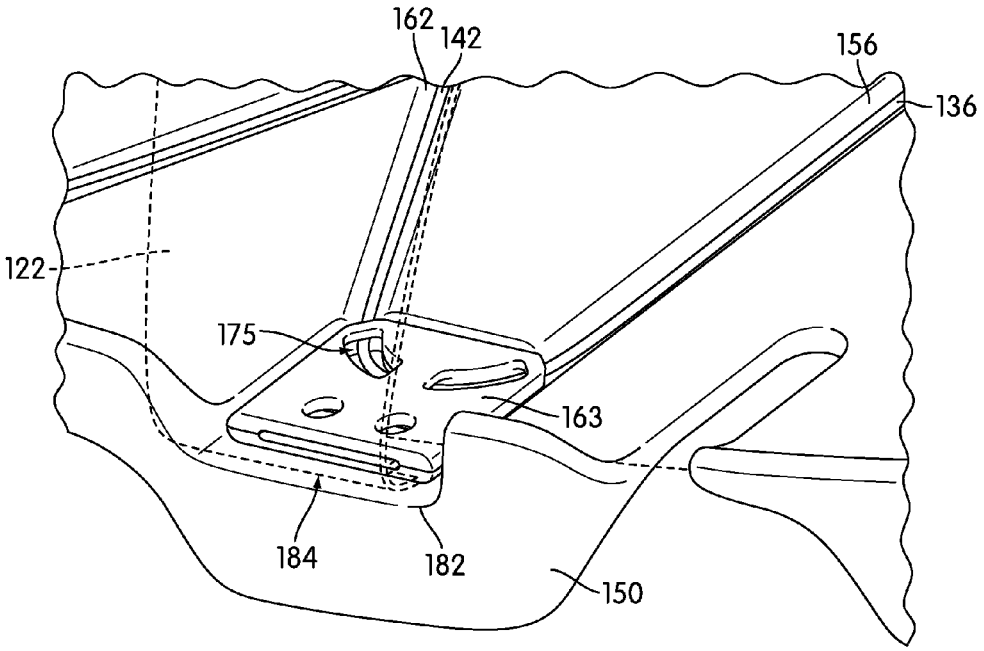
FIG. 9 is an enlarged view of an embodiment of a cable connector that links the cable of a cable tightening system to an upper of an article of footwear.

Each cable connector may be configured to receive a portion of cable 132 in a u-shaped or saddle-shaped configuration so that cable 132 may readily slide within any cable connector. In some embodiments, cable 132 may not be displaceable within a cable connector. In other embodiments, cable 132 may be displaceable within a cable connector, such as by being slidably received within a cable connector, as shown in FIG. 6. FIG. 9 is an enlargement of an embodiment of fourth cable connector 163. As shown, fourth cable connector 163 includes a cable receiving channel 175. A portion of cable 132 may be threaded through cable receiving channel 175 so that cable receiving channel 175 retains the portion of cable 132. Third cable segment 138 feed into a first side of fourth cable connector 163, and fifth cable segment 142 extends out of a second side of fourth cable connector 163.

In some embodiments, such as the embodiment shown in FIGS. 1-14, the tightening mechanism includes pull tab 131. Pull tab 131 may be used to modify cable 132 by either changing the effective length of cable 132, i.e., the length of cable 132 positioned between upper 102 and sole 104, or changing the tension of cable 132. For example, when pulled, the effective length of cable 132 is decreased and the tension in cable 132 is increased, thereby tightening article of footwear 100. When pull tab 131 is released, the effective length of cable 132 is increased and the tension in cable 132 is decreased, thereby loosening article of footwear 100. Pull tab 131 may be configured to be grasped by the fingers of the wearer. Pull tab 131 may have any shape or size to facilitate being manipulated by the hand and fingers of the wearer. Pull tab 131 may be made of any material known in the art, such as the same material as upper 102.

Pull tab 131 may be associated with cable 132 and, in some embodiments, also to upper 102. Pull tab 131 may be associated with cable 132 and, optionally, upper 102 on either side of article of footwear 100. In some embodiments, multiple pull tabs (not shown) may be provided, with all pull tabs on a single side of article of footwear 100 or with some pull tabs being associated with medial side 113 of article of footwear 100 and some pull tabs being associated with lateral side 115 of article of footwear 100. In some embodiments, pull tab 131 may be associated with cable 132 at the arch area of footwear 100.

As shown in FIGS. 3, 5, 7, and 8, pull tab 131 is associated with cable 132 and upper 102 on a medial side 113 of article of footwear 100 in this embodiment. Pull tab 131 is configured to be removably attached to a lateral side 115 of article of footwear 100. Pull tab 131 may be secured to upper 102 using a securing mechanism 133. Securing mechanism 133 may be any type of securing mechanism known in the art, such as a mechanical connector such as snaps, buckles, buttons, or the like. In the embodiment shown in the figures, as shown best in FIG. 3, securing mechanism 133 is a hook and loop connector. First portion 135 of the hook and loop connector is fixedly attached to one side of pull tab 131. Second portion 137 of the hook and loop connector is fixedly attached to lateral side 115 of upper 102. While securing mechanism 133 may be positioned anywhere on upper 102 or sole 104, in some embodiments, second portion 137 of securing mechanism 133 is attached to upper 102 proximate a throat opening 106.

Pull tab connector 147 may be used to associate pull tab 131 with cable 132 and upper 102. Pull tab connector 147 may be any type of mechanical connector known in the art. In some embodiments, pull tab connector 147 may be made of a plastic material formed to accommodate cable 132 and attachment to upper 102. As shown best in FIG. 8, a pull tab cable receiving channel 153 is formed on a first side of pull tab connector 147. In some embodiments, pull tab cable receiving channel 153 is enclosed to guide the sliding movement of cable 153. Apertures may be provided in pull tab cable receiving channel 153 to allow segments of the cable to be threaded through cable receiving channel 153. In the embodiment shown in the figures, first cable aperture 177 is provided to receive fifth cable segment 142, and second cable aperture 179 is provided to receive sixth cable segment 144. The respective lengths of fifth cable segment 142 and sixth cable segment 144 change as the cable slides into and out of cable receiving channel 153.

Pull tab connector 147 may also be used to associate pull tab 131 with upper 102. As shown best in FIGS. 7 and 8, pull tab 131 is associated with upper 102 with first connecting portion 141 and second connecting portion 143. First connecting portion 141 and second connecting portion 143 may be any size, shape, or length desired. In some embodiments, first connecting portion 141 and second connecting portion 143 may be flat ribbons of material so that first connecting portion 141 and second connecting portion 143 may be flexible and durable while retaining the ability to slide with respect to pull tab connector 147. In some embodiments, first connecting portion 141 and second connecting portion 143 may be made of a smooth woven material, such as a woven nylon or polyester material. In other embodiments, first connecting portion 141 and second connecting portion 143 may be made from any material known in the art, such as leather, natural materials, or the like.

In some embodiments, cable 132 may run from a cable connector to pull tab 131. The cable connector associated with pull tab 131 may be any cable connector at any position on footwear 100. Pulling pull tab 131 may cause cable 132 to be pulled tightest between the cable connector and pull tab 131. In some embodiments, pull tab 131 and the cable connector may be associated with footwear 100 proximate to the narrowest portion of sole plate 150. In some embodiments, the rearmost cable connector may be disposed proximate to the narrowest portion of sole plate 150 so that cable 132 is pulled tightest at the narrowest portion of sole plate 150. As shown in FIG. 4, the rearmost cable connector is fifth cable connector 165 so that when pull tab 131 is pulled, cable 132 may be pulled tightest at the narrowest portion of sole plate 150, which is at the arch.

Figure 8:
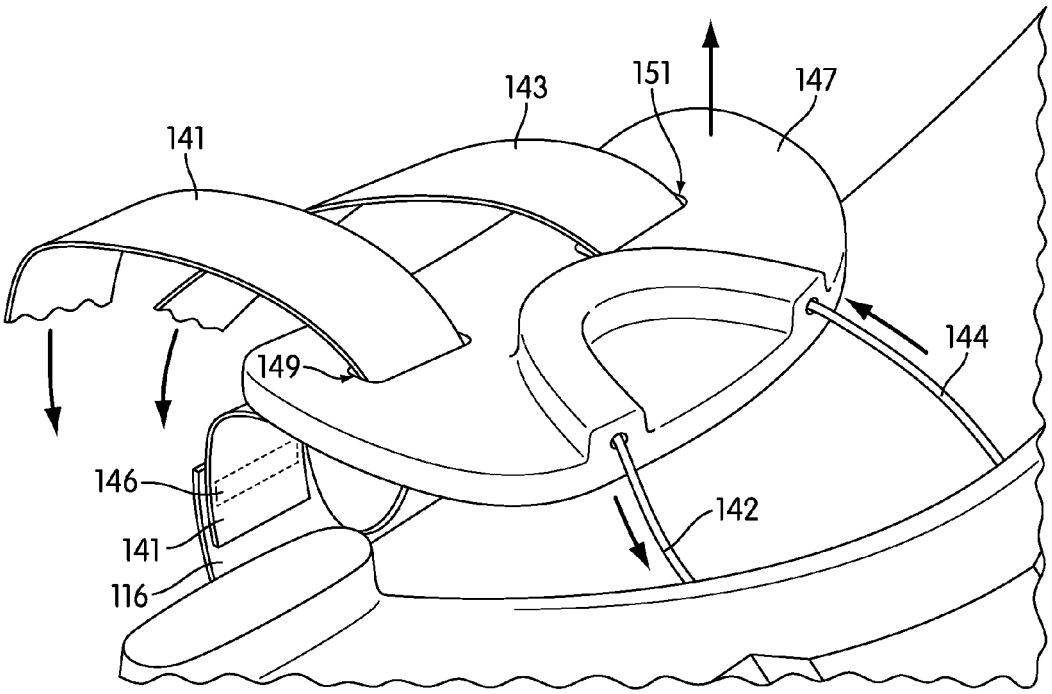
FIG. 8 is an enlarged view of an embodiment of a connector linking the cable of the tightening system to the ribbons of a pull tab.

As is best shown in FIG. 8, a first end of first connecting portion 141 may be fixedly attached to third medial extension 116 of exoskeleton 110. First connecting portion 141 may be secured to third medial extension 116 at first securing location 146 using any method known in the art, such as with stitching or with an adhesive. Similarly, though not shown, second connecting portion 143 is attached to fourth medial extension 118 in a similar fashion as first connecting portion 141 is attached to third medial extension 116. First connecting portion 141 is then threaded through first ribbon aperture 149 formed in pull tab connector 147, and second connecting portion 143 is then threaded through a second ribbon aperture 151 form in pull tab connector 147. As shown best in FIG. 7, first connecting portion 141 and second connecting portion 143 extend to pull tab 131. First connecting portion 141 and second connecting portion 143 are then secured to pull tab 131 using any method known in the art, such as with stitching, an adhesive, welding, or the like.

This configuration of having both cable 132 and exoskeleton 110 attached to pull tab 131 allows cable 132 and exoskeleton 110 to be adjusted simultaneously. By pulling more directly on exoskeleton 110 in the vicinity of throat opening 106, exoskeleton 110 may be tightened slightly more in the vicinity of throat opening 106, which some wearers may find to be more comfortable.

Upper 102 may be associated with sole 104 using any method known in the art. For example, upper 102 may be adhered to sole 104 using an adhesive applied to at least a portion of sole plate 150. Alternatively, upper 102 may be attached to sole 104 by stitching or welding around a periphery of upper 102. To accommodate fastening system 130, in some embodiments, upper 102 is associated with sole 104 by adhering some portions of sole 104 to upper 102 while leaving other portion of sole 104 detached from upper 102.

For example, in the embodiment shown in FIGS. 2-14, sole 104 includes sole plate channel system 152 to accommodate cable 132. As is shown best in FIG. 4, sole plate channel system 152 is a series of grooves that extends into sole plate 150 from upper surface 171 of sole plate 150. Sole plate channel system 152 effectively divides upper surface 171 into sections. Each section may be adhered to bottom surface 169 of upper 102, leaving sole plate channel system 152 detached from upper 102 so that cable 132 may move freely within sole plate channel system 152.

Figure 10:
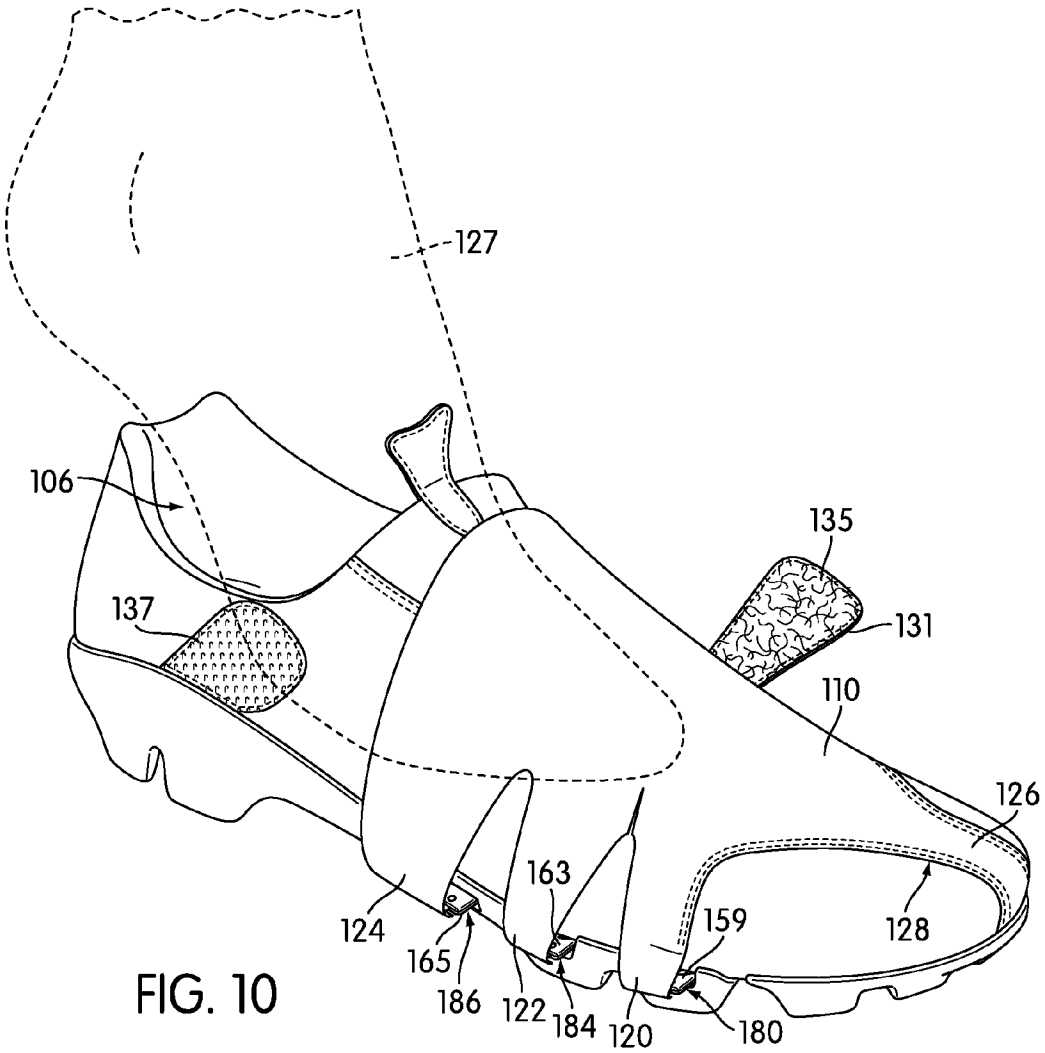
FIG. 10 is a perspective view of an article of footwear having a smooth instep region and a cable tightening system, where the tightening system is loosened to allow the insertion of a foot into the article of footwear.

Similarly, sole 104 may be adhered to upper 102 around a periphery of upper 102. However, cable 132 and first cable connector 157, second cable connector 159, third cable connector 161, fourth cable connector 163, and fifth cable connector 165 move freely between upper 102 and sole 104 and may even be partially extracted from between upper 102 and sole 104, as shown in FIG. 10. Therefore, certain positions around the periphery of upper 102 remain detached from sole 104. These positions generally correspond to first medial notch 166, second medial notch 170, third medial opening 174, fourth medial opening 176, first lateral notch 178, second lateral notch 182, and third lateral opening 186. In other words, upper 102 is detached from sole 104 in positions around the periphery of upper 102 to accommodate the movement of cable 132.

Figure 11:
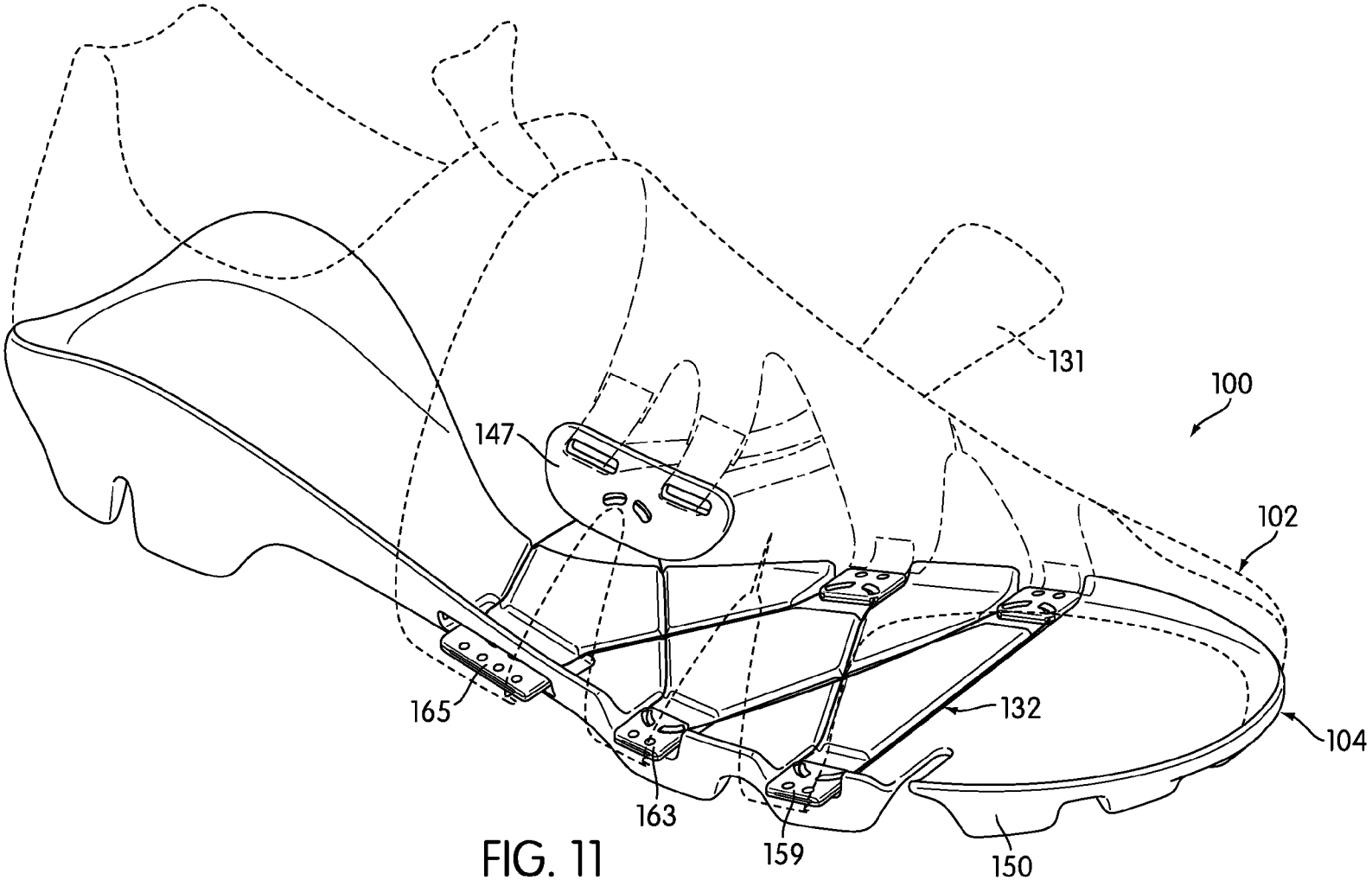
FIG. 11 is a perspective view of an article of footwear having a smooth instep region and a cable tightening system, with the upper shown in phantom to show the cable positioned between the upper and the sole, where the cable is loosened.

FIGS. 10-14 show an embodiment of how article of footwear 100 with a pull tab closure may be positioned and tightened onto a foot 127. FIGS. 10 to 14 show a sequence of putting article of footwear 100 onto foot 127; though not shown, to remove article of footwear 100 from foot 127, the sequence is simply reversed. In FIGS. 10 and 11, exoskeleton 110 is loosened to open throat opening 106 widely to allow foot 127 to be inserted into upper 102 of article of footwear 100. FIG. 11 shows upper 102 in phantom so that cable 132 may better be seen. Pull tab 131 is in an open position, where first portion 135 of the hook and loop connector has been peeled away from second portion 137 to lengthen the effective length of and decrease the tension in cable 132. This loosened condition of cable 132 allows for the extensions of exoskeleton 110 to be pulled slightly away from article of footwear 100.

In some embodiments, cable connectors may be partially extracted from between upper 102 and sole 104. FIGS. 10 and 11 show how the cable connectors may be pulled through the notches and openings in sole 104. FIG. 10 shows how first lateral extension 120 is pulled away from article of footwear 100 so that second cable connector 159 has been pulled through first lateral opening 180. Similarly, second lateral extension 122 has been pulled away from article of footwear 100 so that fourth cable connector 163 has been partially pulled through second lateral opening 184, and third lateral extension 124 has been pulled away from article of footwear 100 so that fifth cable connector 165 has been partially pulled through third lateral opening 186. The position of exoskeleton 110 relative to main body 108 is maintained due to the stitching of toe extension 126 to main body 108.

Figure 12:
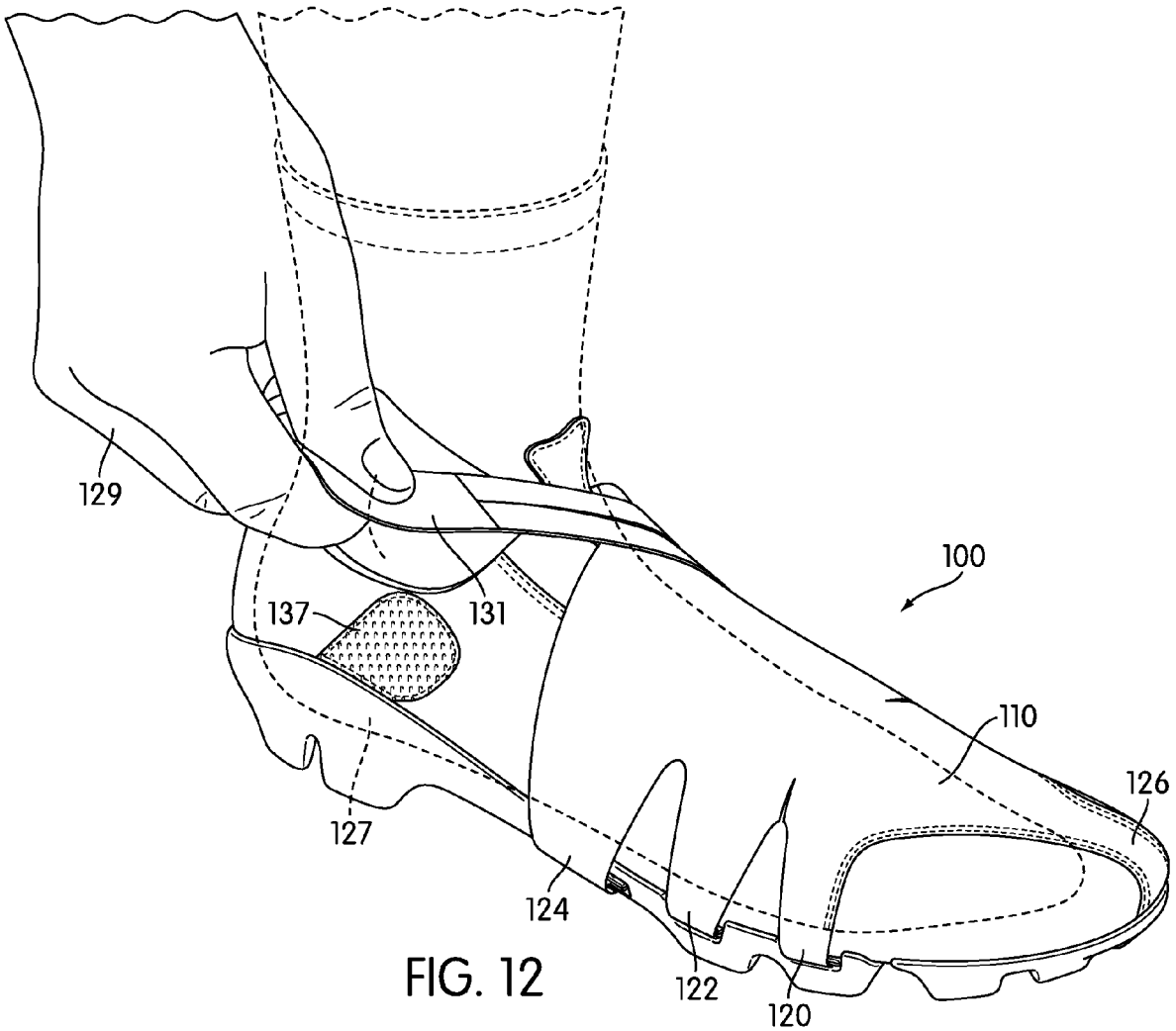
FIG. 12 is a perspective view of an article of footwear having a smooth instep region and a cable tightening system, where tension is being applied to the tightening system to fasten the article of footwear to a foot.
Figure 13:
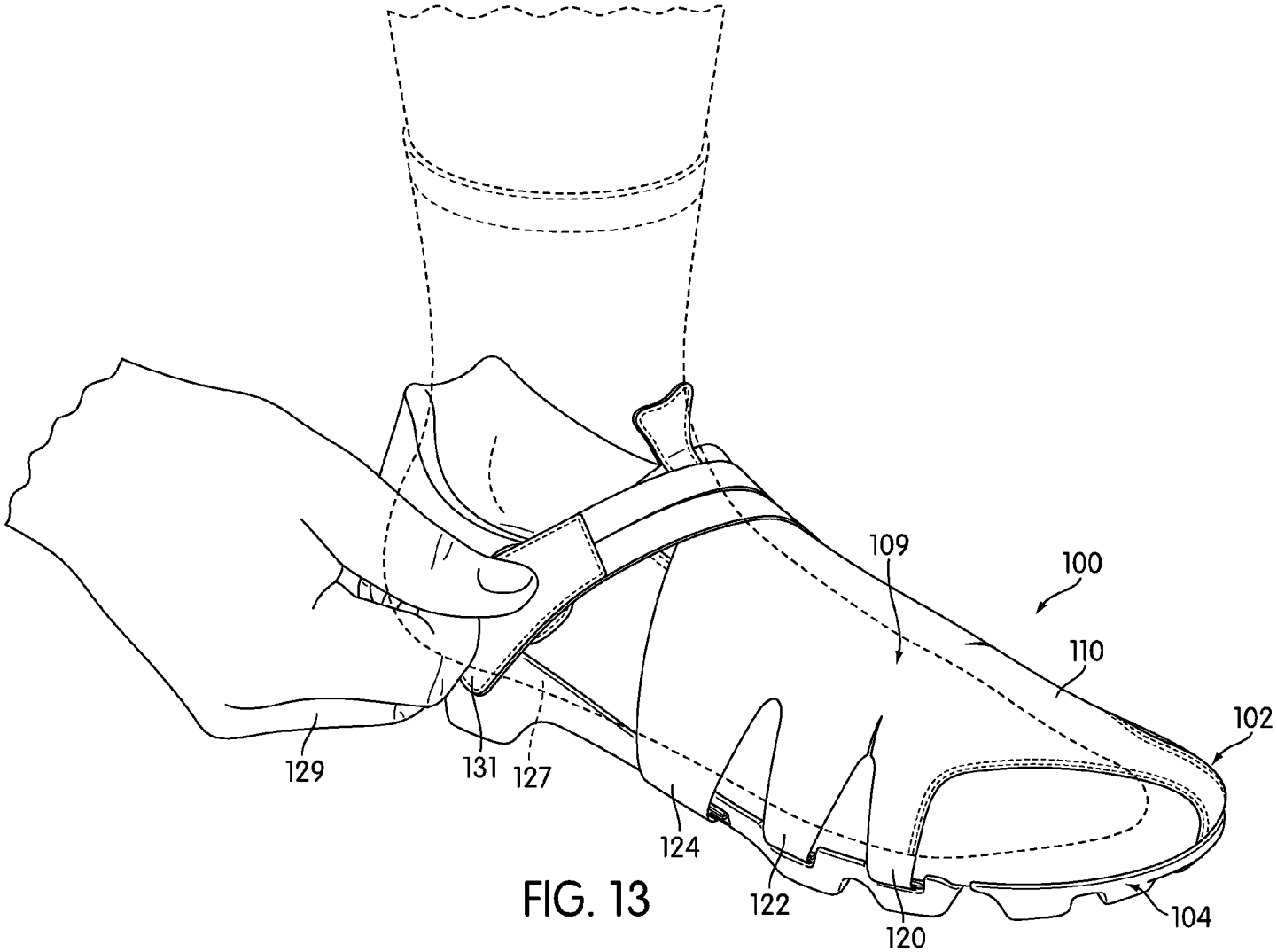
FIG. 13 is a perspective view of an article of footwear having a smooth instep region and a cable tightening system, where the cable tightening system is secured in position after the cables have been tightened to a desired level.
Figure 14:
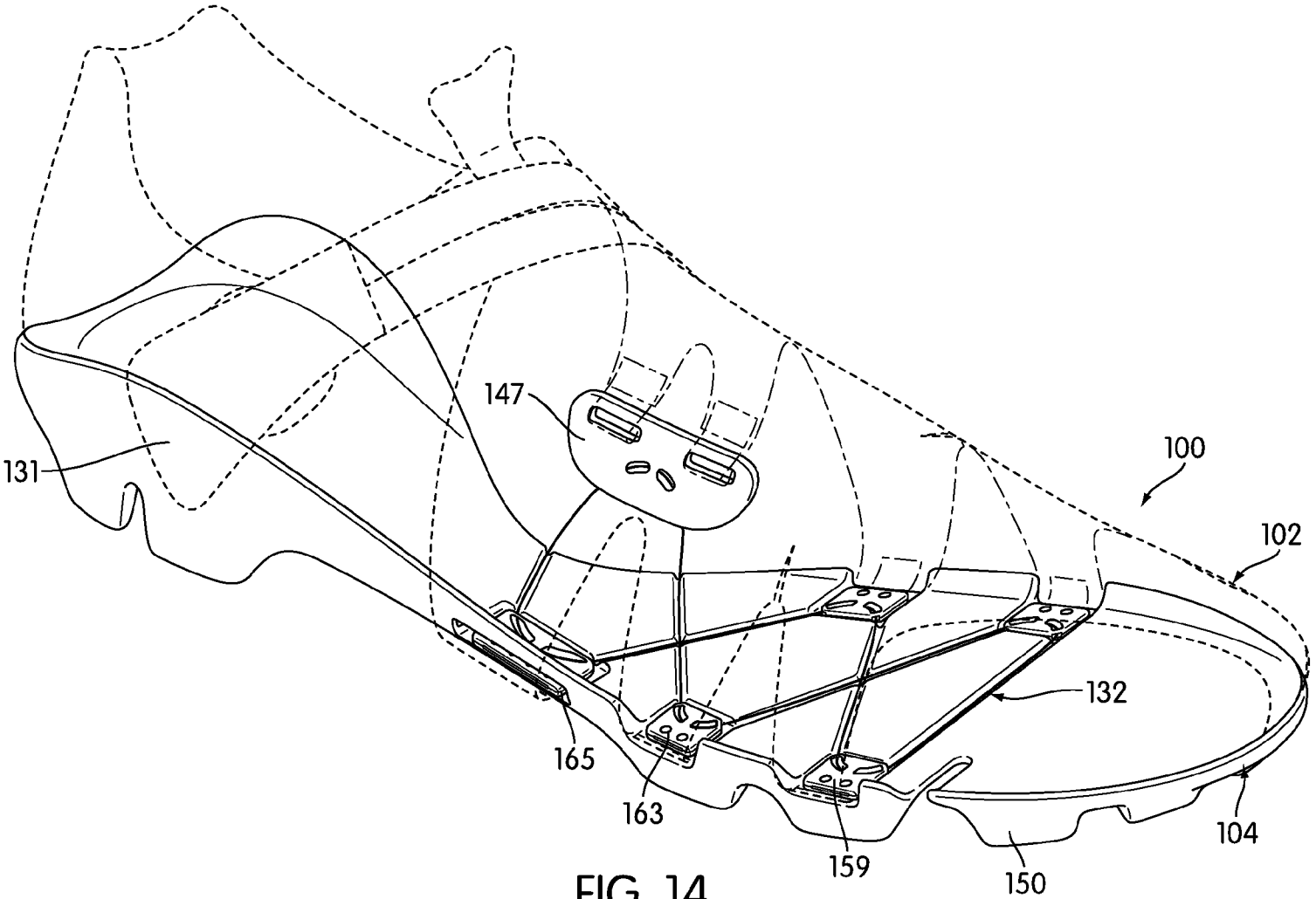
FIG. 14 is a perspective view of an article of footwear having a smooth instep region and a cable tightening system, with the upper shown in phantom to show the cable positioned between the upper and the sole where the cable has been tightened.

FIG. 12 shows pull tab 131 being drawn across article of footwear so that pull tab 131 pulls on cable 132 (not shown) to tighten exoskeleton 110 to foot 127. FIG. 13 shows pull tab 131 being secured to second portion 137 of the hook and loop connector once exoskeleton 110 has been tightened to a desired degree, i.e., when the fit of article of footwear 100 has been adjusted to the liking of a wearer. FIG. 14 shows upper 102 in phantom so that cable 132 may be seen more clearly when cable 132 has been adjusted. A wearer's fingers grasp pull tab 131 so that force may be applied to cable 132. The pulling force decreases the effective length of cable 132 and/or increases the tension within cable 132. When cable 132 is shortened or has increased tension, cable 132 pulls on exoskeleton 110. Exoskeleton 110 is pulled toward sole 104. Some portions of exoskeleton 110 may be drawn in between sole 104 and upper 102, such as the exoskeleton extensions. As exoskeleton 110 is pulled toward sole 104, exoskeleton 110 is cinched to foot 127. This tightens upper 102 onto foot 127 as exoskeleton 110 cinches main body 108 onto foot 127 due to the relative positions of exoskeleton and main body 108.

FIGS. 15-20 show a second embodiment of an article of footwear 200 with a smooth instep region 109. Similar to article of footwear 100, article of footwear 200 includes upper 202 associated with sole 204. Upper 202 may have generally the same configuration as upper 102 discussed above. Sole 204 may have generally the same configuration as sole 104 discussed above. Article of footwear 200 also includes cable-based fastening system 230 with cable 232 similar to fastening system 130 and cable 132 discussed above. However, instead of a pull tab attached to a medial side of the article of footwear for adjusting the fastening system, article of footwear uses reel 231 to adjust the effective length of cable 230. Reel 231 is positioned in heel region 101 of article of footwear 200. Therefore, the structure of upper 202 and sole 204 are slightly different from upper 102 and sole 104 discussed above.

Upper 202 may be made from multiple layers, main body 208 and exoskeleton 210. Main body 208 may be substantially similar to main body 108 discussed above. Main body 208 may be configured to substantially enclose a wearer's foot. Main body 208 may be coincident with upper 202 and define the general shape and size of upper 202. Main body 208 may be made from any material known in the art used for an upper.

Upper 202 also includes exoskeleton 210. Exoskeleton 210 covers at least a portion of instep region 109. In some embodiments, exoskeleton 210 may extend into toe region 105. Exoskeleton 210 may also extend towards a sole-upper interface. In some embodiments, exoskeleton 210 may extend only partially towards the sole-upper interface, while in other embodiments exoskeleton 210 may extend to the sole-upper interface. Exoskeleton 210 may be made of any material known in the art, but in some embodiments, exoskeleton 210 may be made from a material stiffer than that of main body 208. Exoskeleton 210 may be made from a smooth material to provide a smooth instep region surface.

Exoskeleton 210 is associated with main body 208 using any method known in the art. In this embodiment, exoskeleton 210 is associated with main body 208 by stitching exoskeleton 210 to main body 208. While in some embodiments exoskeleton 210 may be associated with main body 208 in only some regions of article of footwear 200, in the embodiment shown in the figures, exoskeleton 210 is stitched to main body 208 around the entirety of the periphery of exoskeleton 210.

Exoskeleton 210 may be configured to receive cable 230. While connectors such as the cable connectors discussed above may be used to associate cable 230 with exoskeleton 210, in some embodiments, exoskeleton 210 may be associated with main body 208 so that a portion of cable 230 is trapped between exoskeleton 210. In the embodiment shown in the figures, the stitchline attaching exoskeleton 210 to main body 208 contains several U-shaped or saddle-shaped portions that define pockets between exoskeleton 210 and main body 208. For example, in FIG. 15, three such pockets are shown on medial side 113 of article of footwear 200: first pocket 257 positioned proximate toe region 105, second pocket 259 positioned between forefoot region 103 and midfoot region 107, and third pocket 261 positioned proximate a throat opening region 111. Similarly, in FIG. 18, three more such pockets are shown on lateral side 115 of article of footwear 200: fourth pocket 263 positioned substantially opposite to first pocket 257 (not shown in FIG. 18), fifth pocket 265 positioned substantially opposite second pocket 259 (not shown in FIG. 18), and sixth pocket 267 positioned substantially opposite third pocket 261 (not shown in FIG. 18). In other embodiments, the pockets may have different configurations.

Cable 232 may be threaded through these pockets in any configurations. In some embodiments, cable 232 may be positioned only around the periphery of article of footwear 200 to form a loop around article of footwear 200. In other embodiments, such as the embodiment shown in the figures, cable 232 may also be threaded between upper 202 and sole 204. In some embodiments, cable 232 may be configured similarly to how cable 132, discussed above, is configured: with some segments stretching straight across the bottom of upper 202 and other segments extending diagonally across the bottom of upper 202, with some of the diagonal segments crossing each other.

Figure 15:
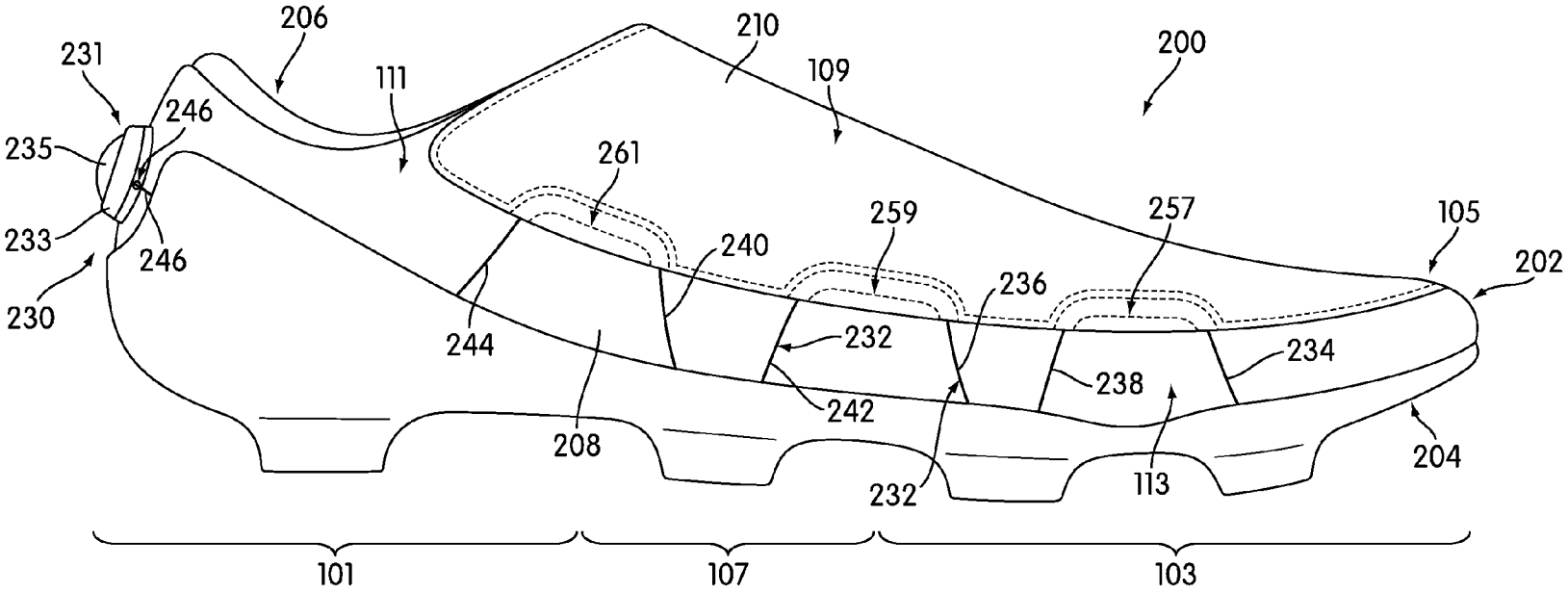
FIG. 15 is side view of a second embodiment of an article of footwear having a smooth instep region and a cable tightening system that includes a reel positioned in a heel region of the article of footwear.

Unlike the embodiment shown in FIGS. 1-14, cable 232 in the embodiment shown in FIGS. 15-20 may extend partially onto upper 202 even when cable 232 is fully tensioned. This may occur when exoskeleton 210 does not extend fully to the sole-upper interface. For example, as shown in FIG. 15, segments of cable 232 are threaded through the pockets, with some portion of the segments remain showing as cable 232 extends from between upper 202 and sole 204 to the pockets. First cable segment 234 enters a first end of first cable pocket 257 and third cable segment 238 exits a second end of first cable pocket 256. Second cable segment 236 enters a first end of second pocket 259 and fifth cable segment 242 exits a second end of second pocket 259. Fourth cable segment 240 enters a first end of third pocket 261 and sixth cable segment 244 exits a second end of third pocket 261. Portions of first cable segment 234, second cable segment 236, third cable segment 238, fourth cable segment 240, and fifth cable segment 242 remain visible on the expanse of main body 208 that spans the distance between a bottom edge of exoskeleton 210 and the top of sole 204.

Cable 232 extends to heel region 101 of article of footwear to reel 231. Two segments of cable 232 may extend to reel 231: eighth cable segment 246 on medial side 113 and ninth cable segment 248 on lateral side 115.

Reel 231 may be disposed anywhere in heel region 101. In some embodiments, reel 231 may be positioned in the center of the back of article of footwear 200, i.e., the furthest position from toe region 105. This position may prevent or inhibit accidentally activating reel 231 while wearing article of footwear 200, as the rear of heel region 101 is unlikely to come into contact with any surface or another article of footwear. In other embodiments, reel 231 may be disposed on a lateral portion of heel region 101. Placing reel 231 on the lateral portion of heel region 101 may minimize contact between reel 231 and a contact surface, such as sporting balls. For example, in soccer, the lateral portion of heel region 101 may be least likely to be used to contact a soccer ball.

Any suitable reel may be used for reel 231, and reel 231 may be any type of reel mechanism known in the art. Some embodiments may use one or more aspects of the reel systems disclosed in Hammerslag, U.S. Pat. No. 7,591,050, which is incorporated by reference in its entirety. In addition to or in the alternative, some embodiments may also use one or more aspects of the reel systems disclosed in Hammerslag, U.S. Pat. No. 6,289,558, which is incorporated by reference in its entirety.

Figure 16:
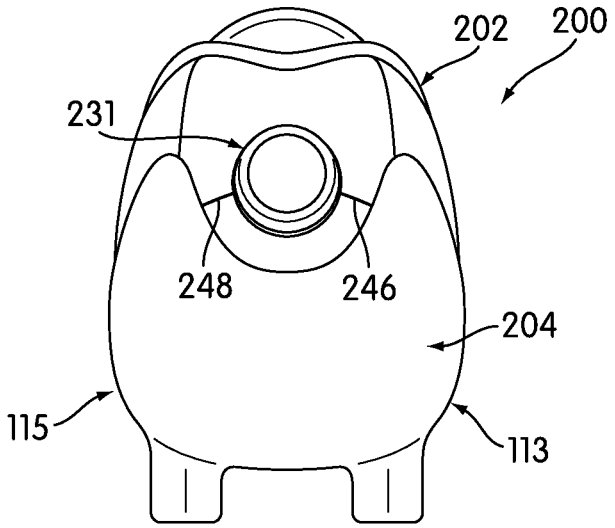
FIG. 16 is a rear view of an embodiment of an article of footwear including a cable tightening system with a reel positioned in a heel region of the article of footwear.
Figure 17:
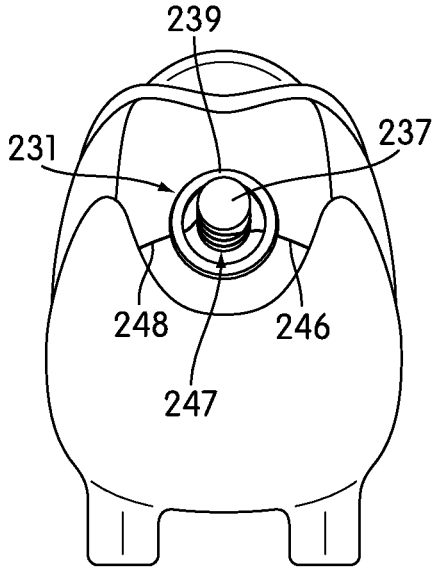
FIG. 17 is a rear view of an embodiment of an article of footwear including a cable tightening system with a reel positioned in a heel region of the article of footwear.

FIGS. 15-17 show one embodiment of a reel 231, with FIGS. 15 and 16 displaying the exterior of reel 231 and FIG. 17 showing the interior portions of reel 231. As shown in FIGS. 15, 16, and 17, reel 231 generally includes handle 233 positioned around an exterior of reel 231, cover 235 positioned in a center of handle 233, spindle 237 positioned generally underneath cover 235, and track 239, generally positioned within handle 233.

Eighth cable segment 246 and ninth cable segment 248 are fed into reel 231 and portions of eighth cable segment 246 and ninth cable segment 248 are wound around spindle 237. Spindle 237 is rotatably mounted to article of footwear 200 so that turning spindle 237 in a first direction will wind more of eighth cable segment 246 and ninth cable segment 248 around spindle 237, thereby decreasing the effective length of cable 232. Turning spindle 237 in a second direction will unwind eighth cable segment 246 and ninth cable segment 248, thereby increasing the effective length of cable 232. In some embodiments, the first direction will be clockwise, and the second direction will be counter-clockwise. In other embodiments, the first direction will be counter-clockwise, and the second direction will be clockwise. Cover 235 may be used to prevent damage to spindle 237 and to retain spindle 237 and cable 232 in position.

Spindle 237 is attached to handle 233. Handle 233 may be used to turn spindle 237 in the first direction, the direction that will wind cable 232. Handle 233 may ride on track 239 to maintain smooth movement of handle 233. When handle 233 is turned, spindle 237 may also be turned in the same direction to wind cable 232. Spindle 237 may be ratcheted so that handle 233 may only turn spindle 237 in one direction. Further, the ratcheting of spindle 237 may lock spindle 237 in position so that the desired length of cable 232 may be maintained. Pulling out reel 231 may release the locking of spindle 237. Spindle 237 may be spring-loaded so that when reel 231 is pulled away from article of footwear 200 to release the locking of spindle 237, spindle 237 will turn in the second direction, the direction that unwinds cable 232.

Figure 18:
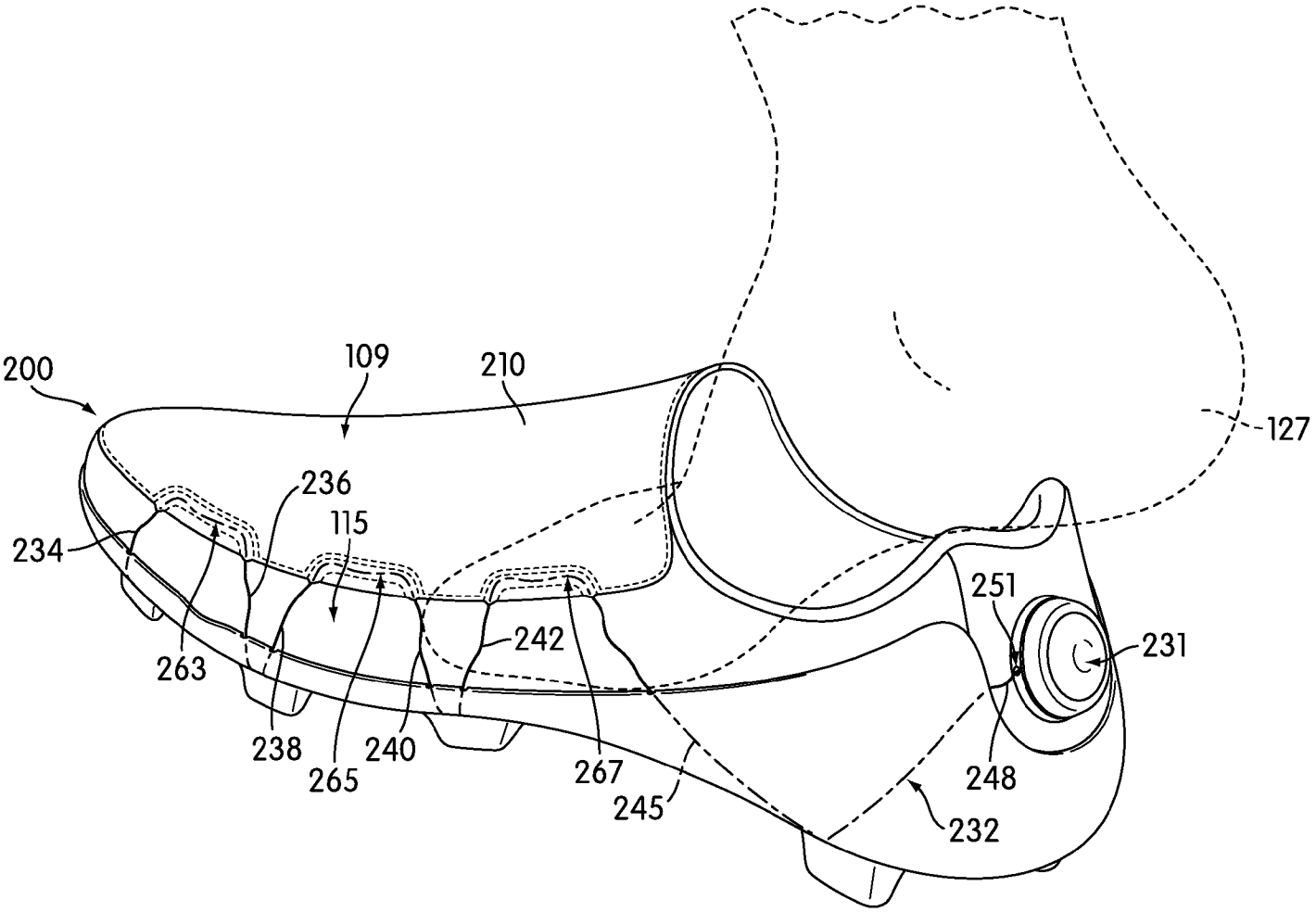
FIG. 18 is rear perspective view of an embodiment of an article of footwear having a smooth instep region and a cable tightening system, where the cable tightening system is loosened to allow a foot to be inserted into the article of footwear.
Figure 19:
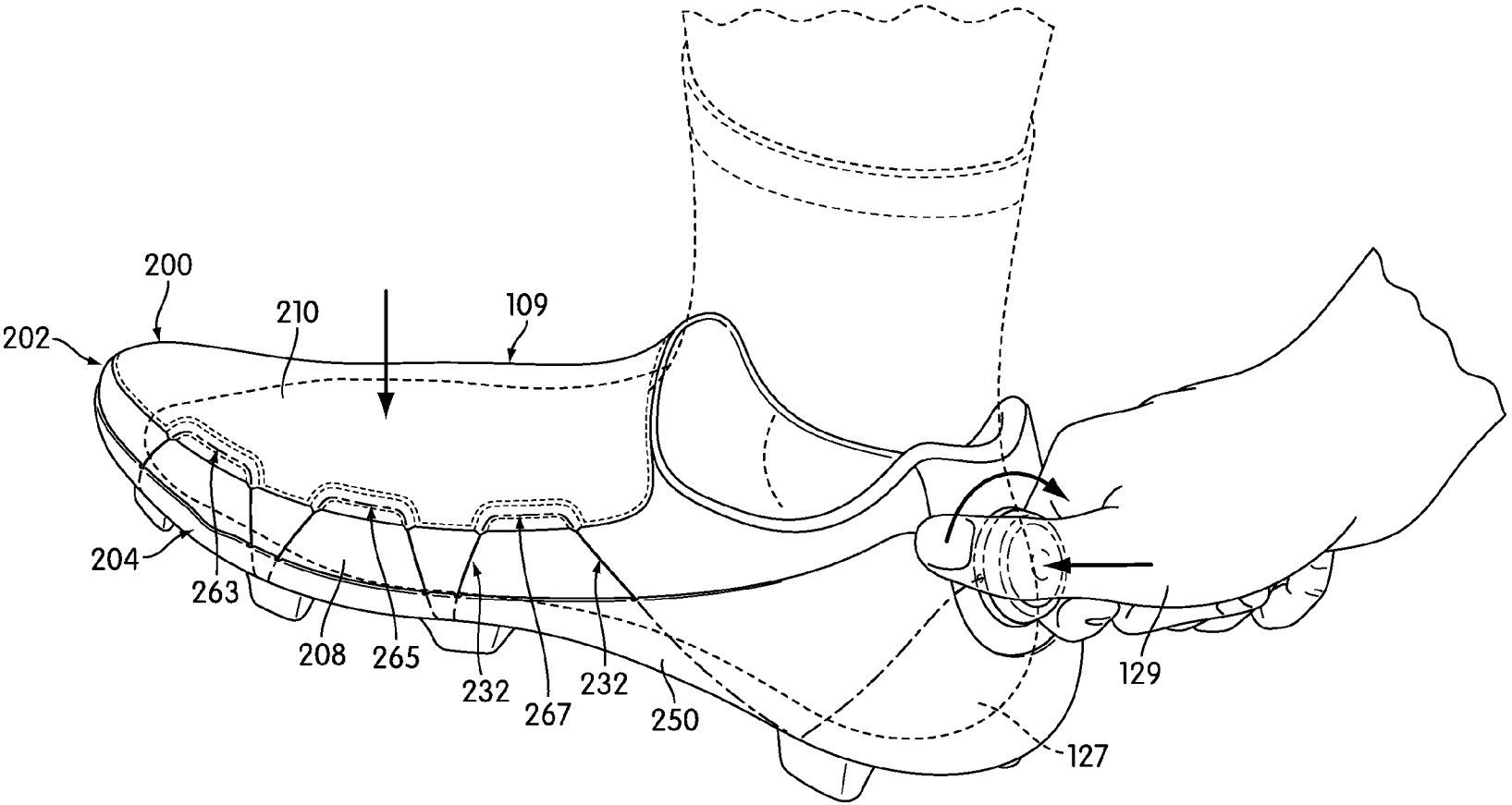
FIG. 19 is a rear perspective view of an embodiment of an article of footwear having a smooth instep region and a cable tightening system, where tension is being applied to the cable of the cable tightening system to secure the article of footwear to the foot.
Figure 20:
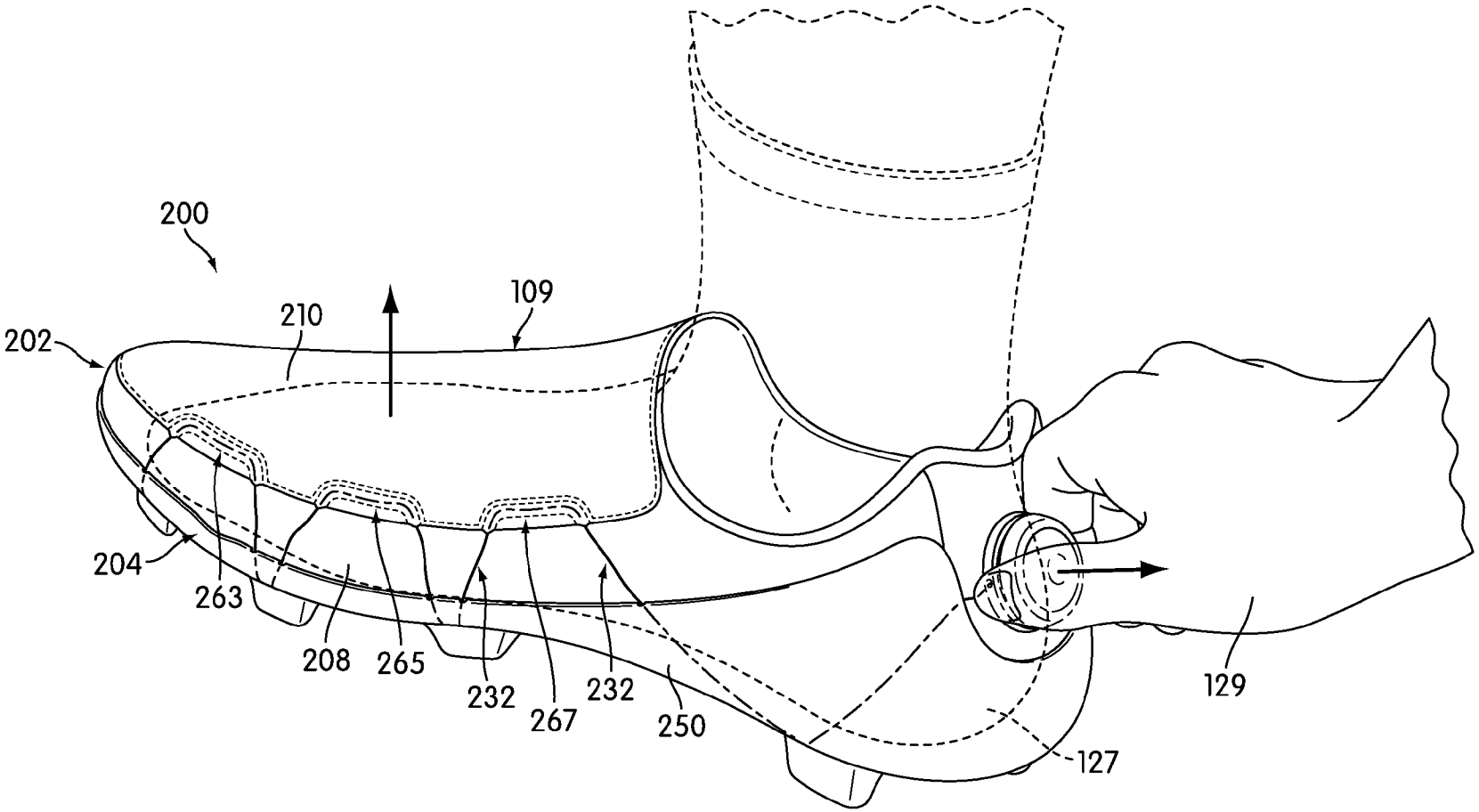
FIG. 20 is a rear perspective view of an embodiment of an article of footwear having a smooth instep region and a cable tightening system, where tension is being released from the cable of the cable tightening system to loosen the article of footwear.

FIGS. 18-20 show one embodiment of how a foot 127 may be inserted into article of footwear 200 and article of footwear 200 tightened and loosened using cable 232 and reel 231. FIG. 18 shows foot 127 being inserted into article of footwear 200. Exoskeleton 210 has been loosened by lengthening cable 232. Slack can be seen in the cable segments on lateral side 115: first cable segment 234, second cable segment 236, third cable segment 238, fourth cable segment 240, fifth cable segment 242, and seventh cable segment 245. Though not shown, the cable segments on medial side 113 will also be slackened to loosen exoskeleton.

FIG. 19 shows hand 129 turning reel 231. Turning reel 231 reduces the length of cable 232 by winding cable 232 around reel 231 as described above. When the slack is removed from cable 232, cable 232 pulls on exoskeleton 210 because cable is threaded through fourth pocket 263, fifth pocket 265, and sixth pocket 267. This pulling motion cinches exoskeleton 210 downward, in the direction of the arrow in instep region 109, toward sole 204.

FIG. 20 shows how cable 232 may be loosened. Hand 129 pulls on reel 231, which motion causes cable 232 to unwind. The effective length of cable 232 is lengthened and slack returns to cable 232. This slack allows exoskeleton 210 to move away from sole 204, in the direction shown by the arrow in instep region 109 in FIG. 20. Once article of footwear 200 has been loosened in this fashion, foot 127 may be more easily extracted from article of footwear 200.

Figure 21:
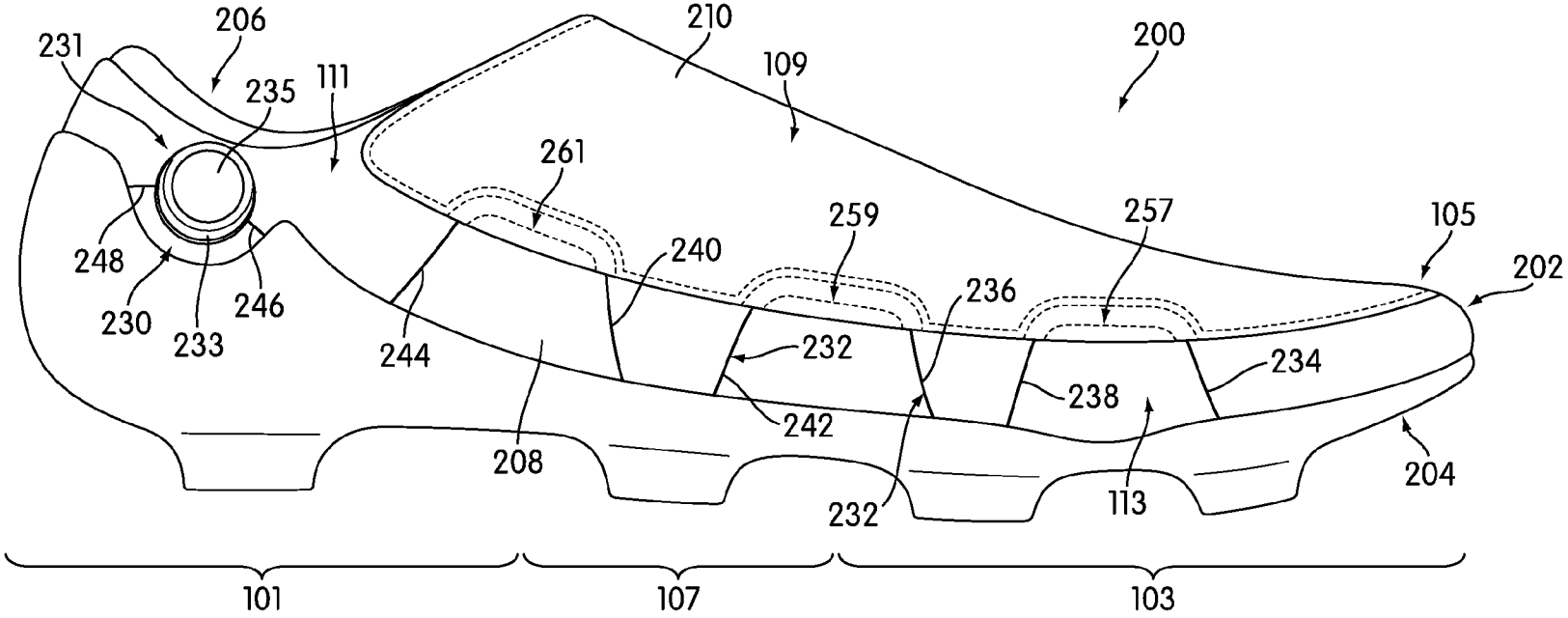
FIG. 21 is a side view of an embodiment of an article of footwear having a smooth instep region and a cable tightening system that includes a reel positioned in a lateral area of a heel region of the article of footwear.

FIG. 21 shows an alternate embodiment of footwear 200. FIG. 21 shows reel 231 may be disposed on a lateral side of heel region 101. In other embodiments, reel 231 may be disposed at other locations on footwear 200.

Figure 22:
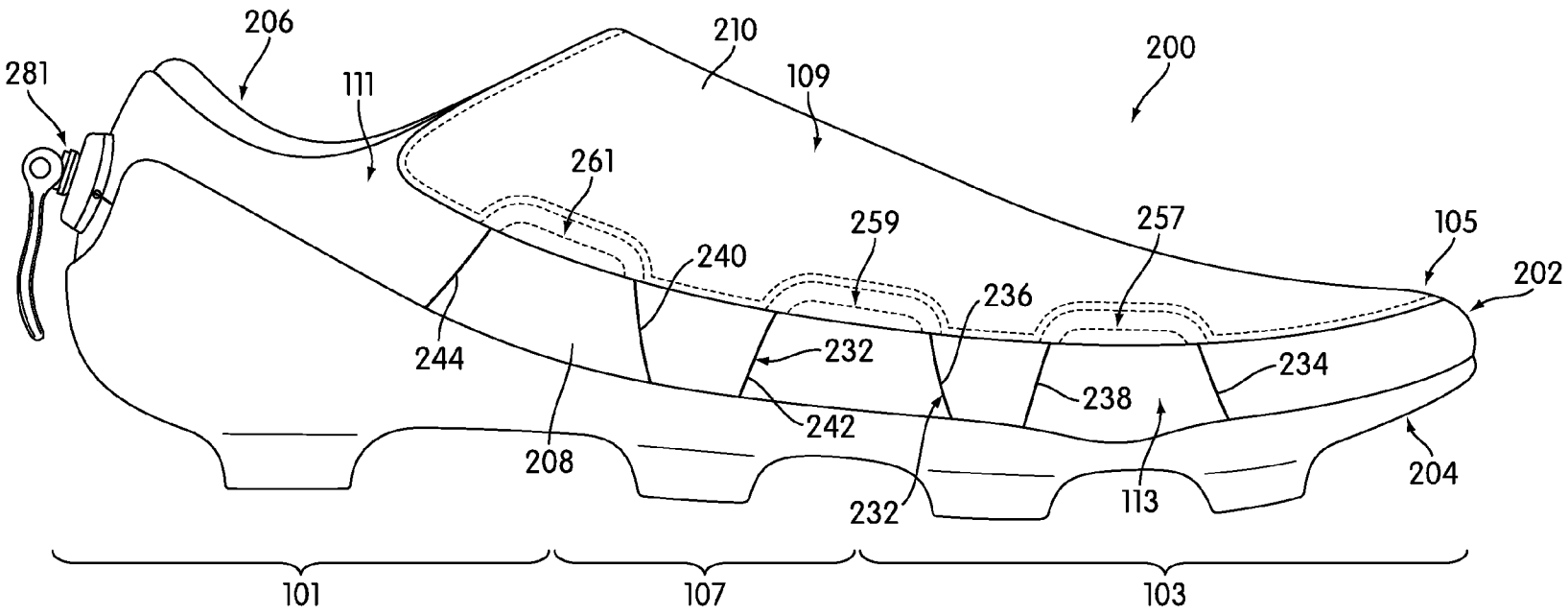
FIG. 22 is a side view of an embodiment of an article of footwear having a smooth instep region and a cable tightening system that includes a spindle positioned in a heel region of the article of footwear and a cam lever locking mechanism attached to the spindle.
Figure 23:
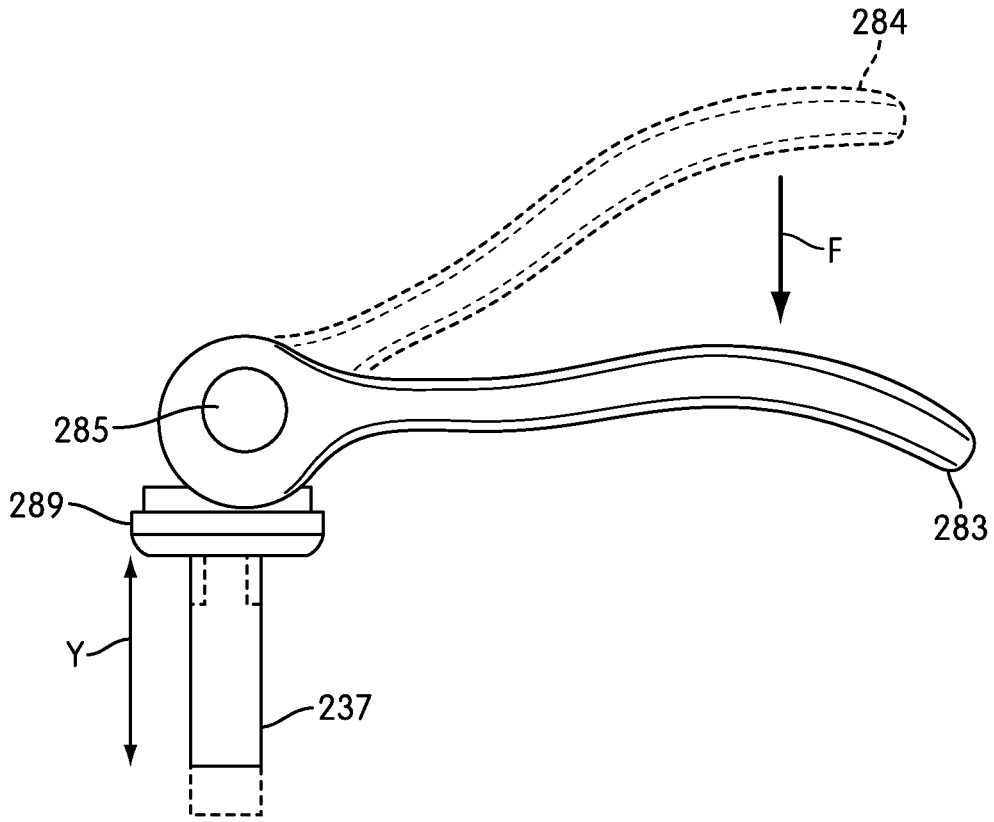
FIG. 23 is a side view of an embodiment of a cam lever locking mechanism for securing a cable tightening system once an article of footwear has been secured to a foot as desired.
Figure 24:
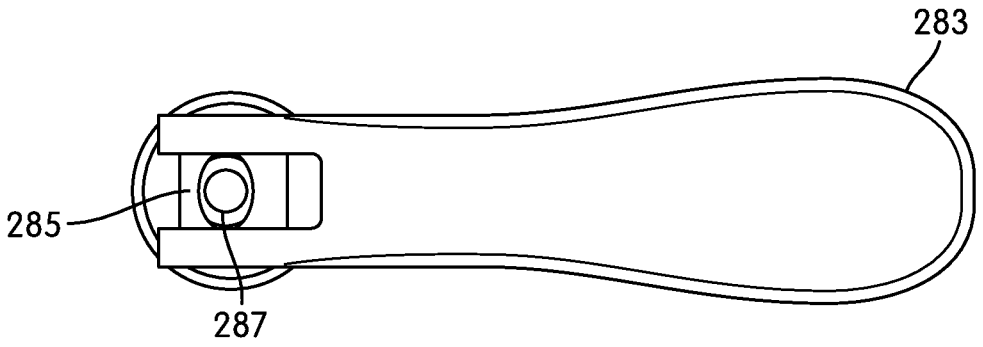
FIG. 24 is a top view of an embodiment of a cam lever locking mechanism.

In some embodiments, a locking mechanism may be used to lock cable 232 in position to maintain the desired length. FIGS. 18-21 show embodiments of how spindle 237 may be locked in position by ratcheting spindle 237 so that the desired length of cable by 232 may be maintained. In other embodiments, the locking mechanism may be a mechanical locking mechanism. Referring to FIGS. 22-24, the locking mechanism may be cam lever 281.

FIGS. 22-24 show an embodiment of footwear 200 having cam lever 281 as the locking mechanism. Cam lever 281 may be any type of a cam lever known in the art. In some embodiments, cam lever 281 may be associated with a mechanism to wind cable 232. Referring to FIGS. 22-24, in some embodiments, cam lever 281 may be attached to spindle 237 to wind cable 232. In some embodiments, spindle 237 may be rotated to wind cable 232 and thereby tighten footwear 200 about the foot. Spindle 237 may also be rotated in an opposite direction to unwind cable 232.

Spindle 237 may be disposed anywhere in the heel region 101. In some embodiments, spindle 237 may be disposed on the center of the rear of heel region 101, i.e., the furthest position from toe region 105, as shown in FIG. 22. In other embodiments, like shown in FIG. 21, spindle 237 may be disposed on a lateral portion of heel region 101.

In some embodiments, cam lever 281 may lock spindle 237 in position so that the desired length of cable 232 may be maintained. In some embodiments, cam lever 281 may lock spindle 237 by applying friction to spindle 237. In some embodiments, cam lever 281 may lock spindle 237 by causing spindle 237 to be pressed against a friction causing surface. A friction causing surface may be a stopper, such as stopper 289. In one embodiment shown in FIGS. 23 and 24, cam lever 281 may cause spindle 237 to be pressed against stopper 289.

FIGS. 23 and 24 show one embodiment of cam lever 271 attached to spindle 237. The workings of this embodiment will now be explained. Other cam levers, using other leverage methods, may also be used.

Cam lever 281 may have pin 287 connected to spindle 237. Pin 287 and spindle 237 may be configured to move along a common axis. The common axis may be any axis. In some embodiments, the common axis may be the Y axis. FIG. 23 shows one embodiment where the common axis is the Y axis that is labeled Y. Pin 287 and spindle 237 may be configured to move along the Y axis from a locked position (shown in solid lines in FIG. 23) to an unlocked position (shown in dotted lines in FIG. 23). In the locked position, spindle 237 may be prevented from rotating around the common axis and the desired length of cable 232 may be maintained. In the unlocked position, spindle 237 may rotate around the common axis to wind and unwind cable 232.

In some embodiments, a handle may be connected to cam 281. One embodiment of a handle is shown in FIGS. 23 and 24. Handle 283 may be connected to pin 287. Handle 283 may rotate about axle 285. Handle 283 may rotate from an open position (shown in dotted lines in FIG. 23) to a closed position 284 (shown in solid lines in FIG. 23) by a user applying force F. Rotating handle 283 may move spindle 237 and pin 287 from the locked position to the unlocked position along the Y axis. When at the open position, spindle 237 may be in an unlocked position and handle 283 may rotate around axle 285 to turn spindle 237 in a direction that will wind cable 232 or to turn spindle 237 in an opposite direction that will unwind cable 232. When at the closed position, spindle 237 may be in locked position and handle 283 may be prevented from rotating around axle 285 so that the desired length of cable 232 may be maintained.

In some embodiments, cam lever 281 may be used as a cable tightening device, instead of, spindle 237. Cable 232 may be directly attached to pin 287 of cam lever 281. Moving pin 287 to a locked position may cause cable 232 to be pulled tight and moving pin 287 to an unlocked position may cause cable 232 to be released. Pin 287 may be moved along the Y axis to the locked and unlocked position by rotating handle 283 along axle 285 to the closed position and open position, respectively, by a user applying force F. Pin 287 may move upward along the Y axis to the locked position from the unlocked position when handle 283 is rotated along axle 285 to the closed position by a user applying force F. Pin 287 may move downward along the Y axis to the unlocked position when handle 283 is rotated along axle 285 to the open position by a user applying an opposing force F.

In this manner, articles of footwear may be provided with smooth instep regions. The smooth instep region may be provided by an exoskeleton formed of a smooth material, where the exoskeleton forms the outer surface of the instep region. Further, the tightening or fastening system for adjusting the fit of the article of footwear to the foot may be shifted from traditional laces to a cable-based system that cinches the exoskeleton toward the sole to tighten the article of footwear to the foot.

Any of parts of the articles of footwear discussed herein may be manufactured using any known technique. The individual parts of any of the articles of footwear discussed herein may be assembled using any known method or technique.

While various embodiments of the invention have been described, the description is intended to be exemplary, rather than limiting and it will be apparent to those of ordinary skill in the art that many more embodiments and implementations are possible that are within the scope of the invention. For example, many types of mechanical locking mechanisms may be used to secure the tightening system/cable, either alone or in combination with a spindle. Accordingly, the invention is not to be restricted except in light of the attached claims and their equivalents. Also, various modifications and changes may be made within the scope of the attached claims.

What is claimed is:

1. An article of footwear comprising:

an upper having a throat opening configured to allow a foot to be inserted into the upper;

the upper having a first layer and an exoskeleton, wherein the first layer defines an upper surface of the upper, and the exoskeleton is positioned on the first layer so that the exoskeleton covers at least a portion of an instep region of the article of footwear;

a tightening system associated with the exoskeleton, the tightening system including a cable;

a sole associated with the upper, the sole comprising channels that extend diagonally across the sole from a medial side to a lateral side and are formed between the upper and the sole for receiving the cable;

wherein the tightening system secures the exoskeleton to the sole, wherein the exoskeleton is configured to provide a smooth instep region;

wherein the exoskeleton is configured to maintain its size and shape when the tightening system is tightened;

and wherein the cable is a continuous loop of material that is disposed in the channels, and wherein the cable can slide within cable connectors attached to lateral extensions of the exoskeleton.

2. The article of footwear according to claim 1, further comprising a pull tab connected to the cable.

3. The article of footwear according to claim 1, wherein the sole comprises a sole plate, and wherein at least one channel is formed in an upper surface of the sole plate.

4. The article of footwear according to claim 1, wherein a first portion of the exoskeleton extends to a toe region of the article of footwear, a second portion of the exoskeleton extends to an interface of the sole and the upper on a medial side of the article of footwear, and a third portion of the exoskeleton extends to the interface of the sole and the upper on a lateral side of the article of footwear, and wherein the first portion of the exoskeleton is fixedly attached to the first layer in the toe region of the article of footwear, and wherein the second portion of the exoskeleton and the third portion of the exoskeleton are detached from the first layer.

5. The article of footwear according to claim 1, wherein the exoskeleton is made from a composite material which is reinforced with filaments and is stiffer than the material of the first layer.

6. The article of footwear according to claim 1, wherein the exoskeleton is partially attached to the first layer such that the exoskeleton can move with respect to the first layer.

7. The article of footwear according to claim 1, wherein a first portion of the cable extends diagonally across the article of footwear from the medial side of the article of footwear to the lateral side of the article of footwear, and a second portion of the cable extends diagonally across the article of footwear from the medial side of the article of footwear to the lateral side of the article of footwear so that the first portion of the cable intersects the second portion of the cable.

8. An article of footwear comprising:

an upper having a throat opening configured to allow a foot to be inserted into the upper;

the upper having a first layer and an exoskeleton, wherein the exoskeleton is positioned on the first layer and is configured to provide a smooth instep region;

a tightening system associated with the exoskeleton, the tightening system including a cable;

a sole associated with the upper, said sole comprising a plurality of channels for receiving the cable;

the cable disposed between the upper and the sole such that the instep region of the upper is devoid of the cable;

wherein the cable is attached to the exoskeleton at a plurality of medial extensions and lateral extensions;

wherein a first set of channels extend diagonally across the sole and at least one channel extends straight across the sole from a medial side of the sole to a lateral side of the sole;

wherein the exoskeleton is configured to maintain its shape and size when the tightening system is tightened;

wherein the cable is a continuous loop of material that is disposed in the channels, and wherein the cable can slide within cable connectors attached to lateral extensions of the exoskeleton.

9. The article of footwear of claim 8, comprising a cable tightener positioned in a heel region of the article of footwear, wherein the cable tightener is configured to tighten the tightening system.

10. The article of footwear of claim 9, wherein the cable tightener comprises a reel system.

11. The article of footwear of claim 8, wherein portions of the cable extend diagonally through the channels from the medial side of the article of footwear to the lateral side of the article of footwear.

12. The article of footwear of claim 8, further comprising a locking mechanism that locks the cable in position.

13. The article of footwear of claim 12, wherein adjustment of the cable allows for uniform tightening of the exoskeleton against a wearer's foot.

14. The article of footwear of claim 8, wherein the sole comprises a sole plate and the channels are formed by grooves in the sole plate.

15. An article of footwear comprising:

an upper comprising a first layer and an exoskeleton;

the first layer defining a shape of the upper;

the exoskeleton having a main body positioned to cover a portion of an instep of the first layer, wherein the exoskeleton is configured to provide a smooth instep region;

a cable positioned between the upper and a sole, the sole comprising a sole plate;

the cable configured to tighten the article of footwear to a foot by drawing the exoskeleton toward the sole when tension is applied to the cable; and a plurality of channels in the sole plate configured to receive the cable;

wherein the cable is a continuous loop of material that is looped through the channels in the sole and is slidably received in cable connectors attached to lateral extensions of the exoskeleton at the periphery of the exoskeleton; and wherein the exoskeleton is configured to maintain its size and shape when the tightening system is tightened.

16. The article of footwear according to claim 15, wherein the cable connectors are fixedly attached to the exoskeleton.

17. The article of footwear according to claim 15, wherein the exoskeleton is made of a material that is more stiff than the material of the first layer.

18. The article of footwear according to claim 15, wherein a first portion of the exoskeleton is fixedly attached to the first layer and at least one other portion of the exoskeleton is not fixedly attached to the first layer.

19. The article of footwear according to claim 15, wherein a pull tab is associated with the cable on a medial side of the article of footwear, and wherein the pull tab is secured to the article of footwear proximate a throat opening on the lateral side of the article of footwear.

20. The article of footwear according to claim 15, wherein the cable is disposed in the plurality of channels and is under horizontal tension, and a cable connector translates that horizontal tension into vertical tension.

* * * * *